US010844664B2

(12) United States Patent
Nelson

(10) Patent No.: US 10,844,664 B2
(45) Date of Patent: Nov. 24, 2020

(54) GANTRY AND QUICK CONNECT MECHANISM FOR INTERCHANGING DRILLING AND BOLTING ASSEMBLIES AND METHOD OF INTERCHANGING BOLTING ASSEMBLIES

(71) Applicant: Yves Nelson, Algoma Mills (CA)

(72) Inventor: Yves Nelson, Algoma Mills (CA)

(73) Assignee: 1311854 Ontario Limited, Elliot Lake (CA)

( * ) Notice: Subject to any disclaimer, the term of this patent is extended or adjusted under 35 U.S.C. 154(b) by 519 days.

(21) Appl. No.: 15/598,665

(22) Filed: May 18, 2017

(65) Prior Publication Data

US 2018/0119492 A1 May 3, 2018

Related U.S. Application Data

(60) Provisional application No. 62/415,375, filed on Oct. 31, 2016.

(51) Int. Cl.

| | |
|---|---|
| ***E21B 7/02*** | (2006.01) |
| ***E21B 19/08*** | (2006.01) |
| ***E21D 20/00*** | (2006.01) |
| ***E21D 21/00*** | (2006.01) |

(52) U.S. Cl.

CPC ..... *E21B 7/027* (2013.01); *E21B 7/023* (2013.01); *E21B 7/025* (2013.01); *E21B 19/08* (2013.01); *E21D 20/003* (2013.01); *E21D 21/008* (2013.01)

(58) Field of Classification Search

CPC ..... E21B 7/027; E21B 7/023; E21B 19/08; E21B 7/025; E21D 21/008; E21D 20/003

USPC ..... 173/184, 90

See application file for complete search history.

(56) References Cited

U.S. PATENT DOCUMENTS

| | | | | | |
|---|---|---|---|---|---|
| 1,856,065 | A * | 5/1932 | Austin | A01C 5/02 | 111/94 |
| 2,217,674 | A * | 10/1940 | Curtis | E21B 7/024 | 173/187 |
| 2,303,565 | A * | 12/1942 | Luna | B23B 45/02 | 173/214 |
| 3,783,955 | A * | 1/1974 | Gill | B25F 3/00 | 173/50 |
| 3,967,686 | A * | 7/1976 | Fogelstrom | E21B 7/025 | 173/184 |
| 4,226,559 | A * | 10/1980 | Prebensen | E21B 7/025 | 173/184 |
| 4,264,051 | A * | 4/1981 | Walmsley | E21B 7/025 | 173/195 |
| 4,420,277 | A * | 12/1983 | Hibbard | E21D 20/006 | 173/32 |

(Continued)

*Primary Examiner* — Robert F Long
(74) *Attorney, Agent, or Firm* — Gardner Linn

(57) ABSTRACT

A bolting and drilling system comprising a vehicle, a gantry mounted to the vehicle, a boom assembly having a first end mounted to the gantry and a second end having a first quick connector and a second quick connector. The system includes a bolter assembly connectable to the first quick connector, wherein the bolter assembly comprises a stinger, a drill and a bolter for stinging, drilling and bolting a roof of an underground mine. The system includes a drill feed assembly connectable to the second quick connector, wherein the drill feed assembly comprises a drill for drilling a rock face of a heading. The drill feed assembly is longer than the bolter assembly.

8 Claims, 30 Drawing Sheets

(56) References Cited

U.S. PATENT DOCUMENTS 4,512,693 A * 4/1985 Swanson ..... B23B 51/00 279/14
4,810,916 A * 3/1989 McBride ..... B23B 45/001 310/50
4,915,549 A * 4/1990 Riddell ..... B23B 39/16 408/43
5,063,796 A * 11/1991 Gennep ..... B25B 13/481 362/120
5,125,460 A * 6/1992 Behrens ..... E21B 7/046 173/184
5,149,230 A * 9/1992 Nett ..... B25B 21/00 408/125
5,261,135 A * 11/1993 Mitchell ..... B25B 21/00 173/50
5,276,929 A * 1/1994 Mitchell ..... B25B 21/00 173/50
5,325,581 A * 7/1994 Sun ..... B23Q 39/042 269/266
5,490,568 A * 2/1996 Rios ..... A01G 17/16 173/184
5,540,292 A * 7/1996 Behrens ..... E21B 7/02 173/184
5,556,235 A * 9/1996 Morrison ..... E21D 20/006 227/119
5,944,452 A * 8/1999 Reinert, Sr. ..... E02F 3/963 173/184
6,152,244 A * 11/2000 Rokbi ..... E02F 9/0841 173/184
6,305,480 B1 * 10/2001 Franklin ..... E21B 1/02 173/147
6,413,019 B1 * 7/2002 Coombs ..... E21D 20/006 173/38
7,066,692 B2 * 6/2006 Kuhn ..... B25F 3/00 173/216
7,367,757 B2 * 5/2008 Phillips ..... B23B 45/003 173/214
7,371,033 B2 * 5/2008 Whitehead ..... B25F 3/00 173/214
8,297,158 B2 * 10/2012 Watanabe ..... B23B 3/165 29/27 R
8,956,082 B2 * 2/2015 Nelson ..... E21D 20/00 405/259.1
9,284,839 B2 * 3/2016 Nelson ..... E21D 20/003
9,567,854 B2 * 2/2017 Nelson ..... E21D 20/003
10,400,526 B2 * 9/2019 Nelson ..... E21B 19/24
2003/0066665 A1 * 4/2003 Coombs ..... E21D 20/006 173/32
2006/0272862 A1 * 12/2006 Hinshaw ..... E21D 20/006 175/52
2008/0267739 A1 * 10/2008 Spilker ..... E04H 17/263 414/23
2009/0145520 A1 * 6/2009 Opsitos, Jr. ..... B23B 45/02 144/108
2010/0012340 A1 * 1/2010 Kuosnnanen ..... E21B 7/023 173/184
2011/0100659 A1 * 5/2011 Murate ..... E02D 7/16 173/104
2012/0247836 A1 * 10/2012 Wilson ..... E21D 20/003 175/57
2013/0140053 A1 * 6/2013 Niekamp ..... E02D 7/08 173/93
2013/0228377 A1 * 9/2013 Kuittinen ..... E21B 7/025 175/57
2014/0037415 A1 * 2/2014 Zuritis ..... E02F 3/06 414/695.5
2014/0112724 A1 * 4/2014 Nelson ..... E21D 20/00 405/259.1
2014/0345895 A1 * 11/2014 Lee ..... E21B 41/0078 173/1
2015/0300170 A1 * 10/2015 Nelson ..... E21D 20/003 405/259.1
2016/0138299 A1 * 5/2016 Powers, III ..... E04H 17/263 173/184
2016/0215622 A1 * 7/2016 Nelson ..... E21D 20/003
2018/0119492 A1 * 5/2018 Nelson ..... E21B 7/023

* cited by examiner

GANTRY AND QUICK CONNECT MECHANISM FOR INTERCHANGING DRILLING AND BOLTING ASSEMBLIES AND METHOD OF INTERCHANGING BOLTING ASSEMBLIES

CROSS-REFERENCE TO RELATED APPLICATION

The present application claims the filing benefits of U.S. provisional application Ser. No. 62/415,375, filed Oct. 31, 2016, which is hereby incorporated herein by reference in its entirety.

TECHNICAL FIELD

The present invention relates generally to mining equipment and, in particular, to rock drilling and rock bolting.

BACKGROUND

In an underground mine, ground support, e.g., rock bolts and screening, is used to prevent rock falls. Several different types of rock bolts may be used but all require that holes be drilled in the rock first. This is done with equipment known as rock bolters. These are mobile units with a bolting head attached. To drill a hole in the rock to install ground support, the bolting head is placed against the rock face (which is called "stinging the face") and then a hole is drilled into the rock. The unit is then indexed to install the rock bolt as ground support.

In typical narrow vein mining, the conventional practice is to blast the rock at the heading and then to muck out the heading by clearing away debris from the blasting using, for example, a scoop tram or other underground loader. A bolter is then moved into the narrow vein to install rock bolts for rock support in the roof of the narrow vein. The bolter then backs out and a drilling machine is moved into the heading to drill the face. Explosives are then inserted into the holes drilled in the rock face. The process of blasting, mucking, bolting and drilling is then repeated to advance the heading.

Conventionally, in narrow vein mining, there is insufficient room to use a single jumbo drilling and bolting rig up to the heading. Because of the restricted size of the narrow vein, it is conventional practice to employ two vehicles, one for bolting the roof and then one for drilling the face. This is time-consuming because the bolter has to be backed out of the narrow vein before the drilling equipment can be moved into the narrow vein. In addition, the practice of using two different bolting and drilling rigs is expensive in terms of capital acquisition costs, maintenance costs, mine ventilation costs and the opportunity cost of lost production time during the swap procedure. Although these concerns are most acute in narrow vein mining, similar concerns may also exist with respect to mining operations in drifts that are broader than narrow veins.

A need therefore exists for an effective solution to this hitherto unresolved technical problem.

SUMMARY

In broad terms, the present invention provides a novel system and method for bolting a roof and drilling a face of in a drift or narrow vein of an underground mine.

Accordingly, one inventive aspect of the present disclosure is a bolting and drilling system comprising a vehicle, a boom assembly having a first end mounted to the vehicle and a second end having a first quick connector and a second quick connector. The system includes a bolter assembly connectable to the first quick connector, wherein the bolter assembly comprises a stinger, a drill and a bolter for stinging, drilling and bolting a roof of an underground mine. The system includes a drill feed assembly connectable to the second quick connector, wherein the drill feed assembly comprises a drill for drilling a rock face of a heading. The drilling assembly or drill feed assembly is longer than the bolter assembly. In one embodiment, the system includes a gantry disposed at a front of the vehicle to which the boom is mounted, the gantry being movable relative to the vehicle to extend or retract the drill feed assembly or the bolter assembly.

Another inventive aspect of the present disclosure is a method of bolting and drilling using a single bolting and drilling system in an underground mine. The method entails driving a vehicle to a heading having a roof to be bolted and a face to be drilled. The vehicle includes a boom assembly having a first end mounted to the vehicle and a second end having a first quick connector and a second quick connector, a bolter assembly connectable to the first quick connector, wherein the bolter assembly comprises a stinger, a drill and a bolter for stinging, drilling and bolting a roof of an underground mine. The vehicle includes a drill feed assembly connectable to the second quick connector, wherein the drill feed assembly comprises a drill for drilling a rock face of a heading. The drilling assembly or drill feed assembly is longer than the bolter assembly. The method further entails disconnecting the drill feed assembly, bolting the roof using the bolter assembly, disconnecting the bolter assembly, connecting the drill feed assembly, and drilling the face using the drill feed assembly. In one embodiment, the method involves displacing a gantry disposed at a front of the vehicle to extend or retract the drill feed assembly or the bolter assembly relative to the vehicle.

This summary is provided to highlight certain significant inventive aspects but is not intended to be an exhaustive or limiting definition of all inventive aspects of the disclosure. Other inventive aspects may be disclosed in the detailed description and drawings.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

Figure 1:
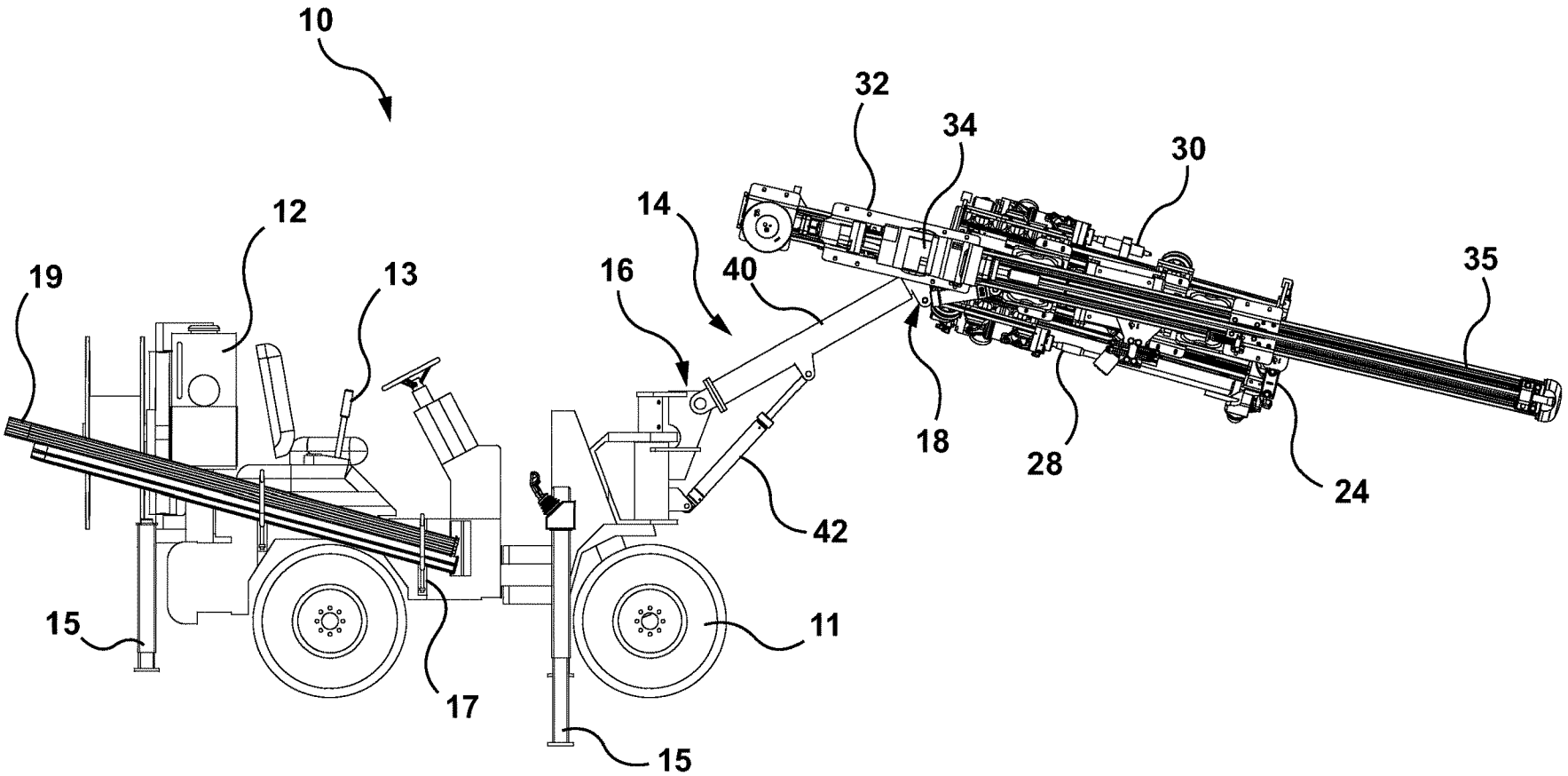
FIG. 1 is a side view of the bolting and drilling system having a single boom in accordance with a first embodiment of the present invention.
Figure 2:
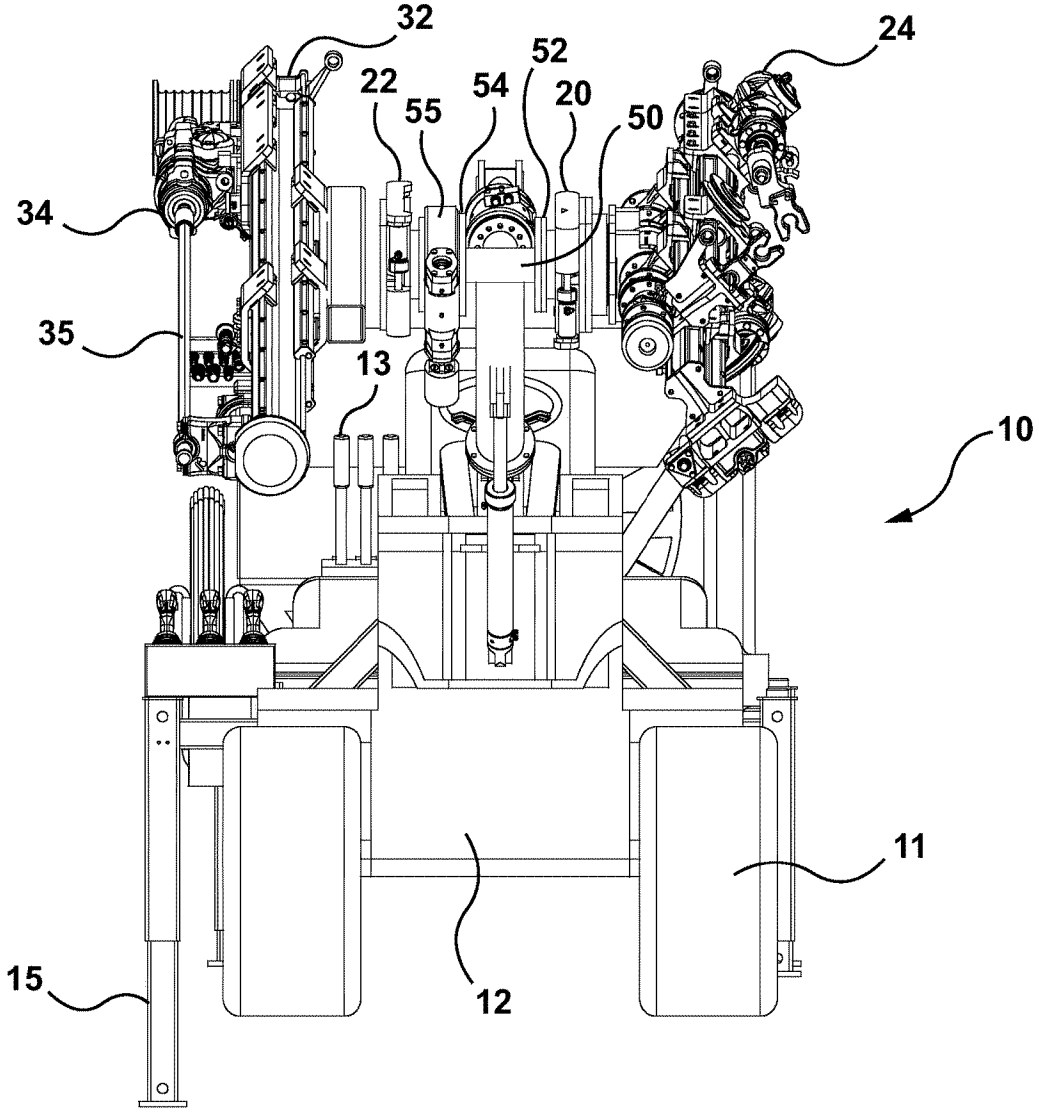
FIG. 2 is a front view of the system of FIG. 1.
Figure 3:
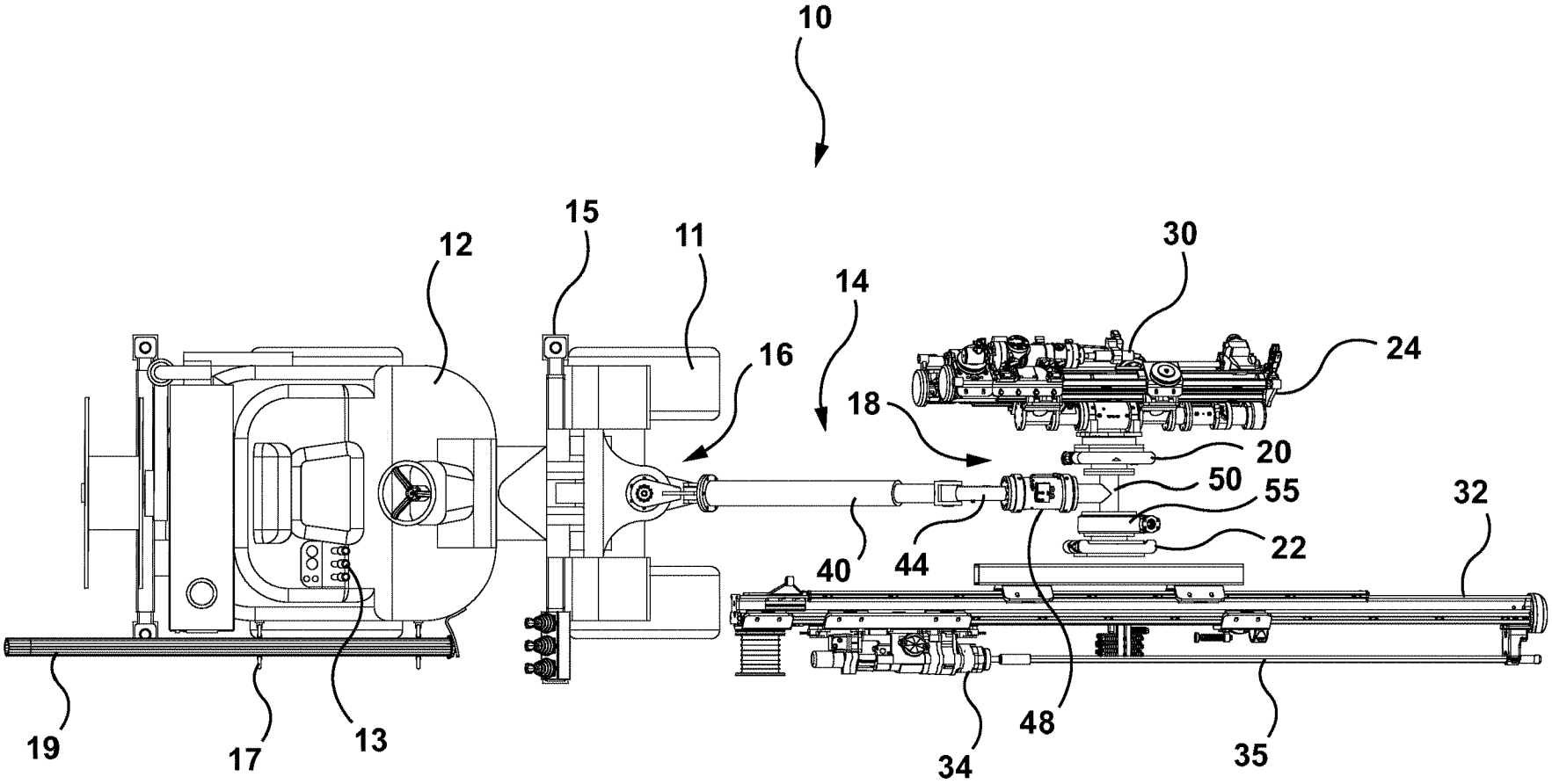
FIG. 3 is a top view of the system of FIG. 1.
Figure 4:
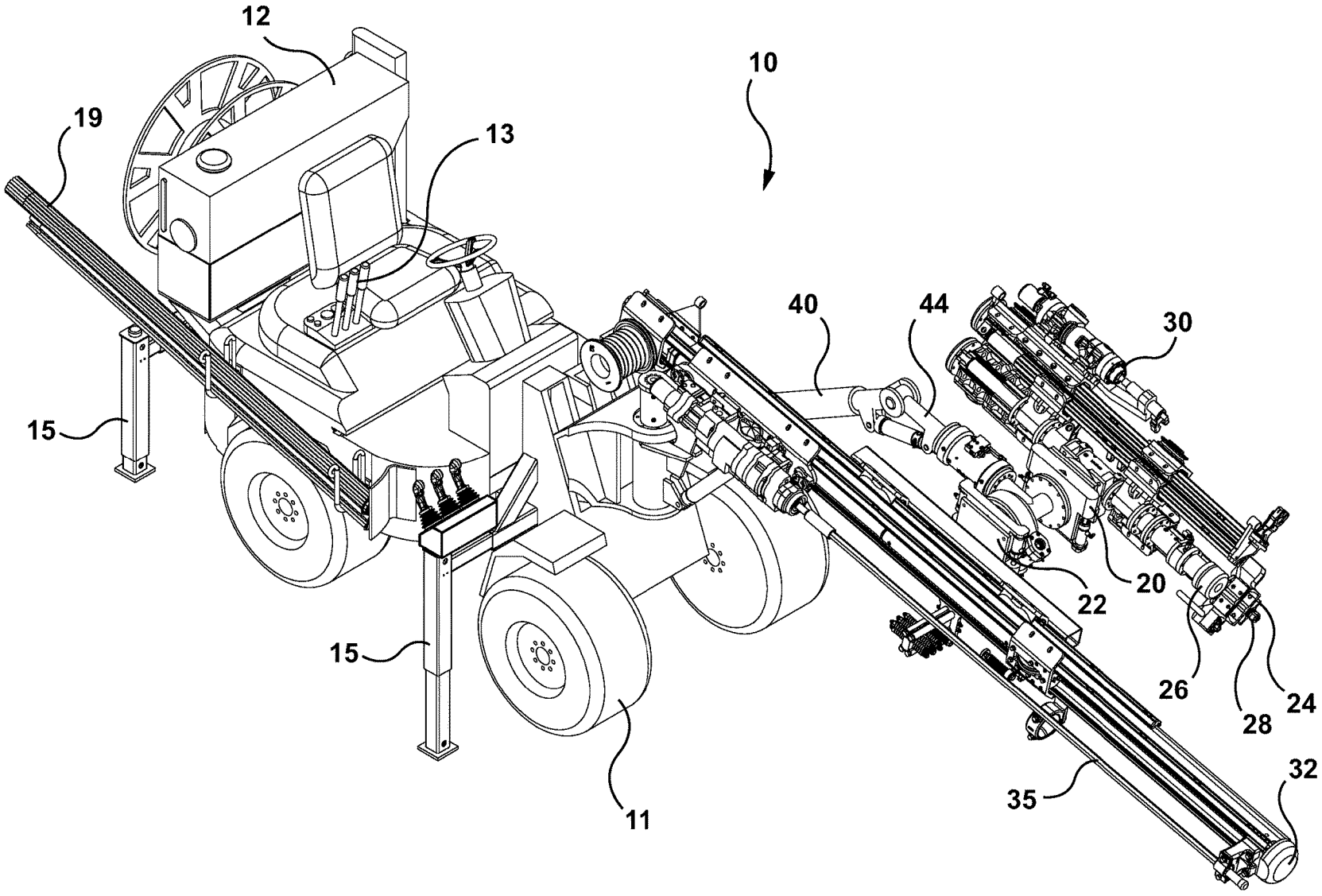
FIG. 4 is an isometric view of the system of FIG. 1.
Figure 5:
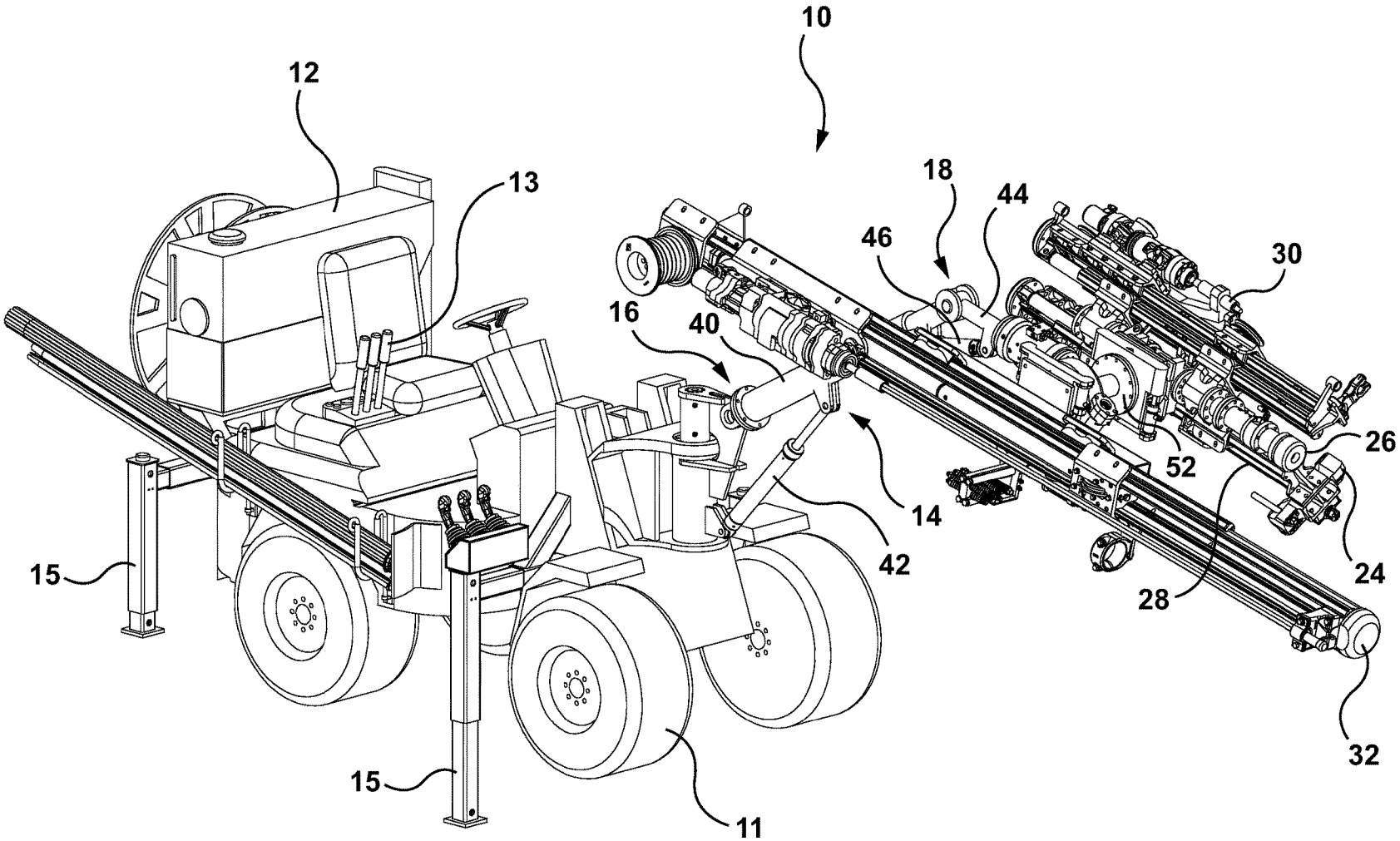
FIG. 5 is a dimetric view of the system of FIG. 1.
Figure 6A:
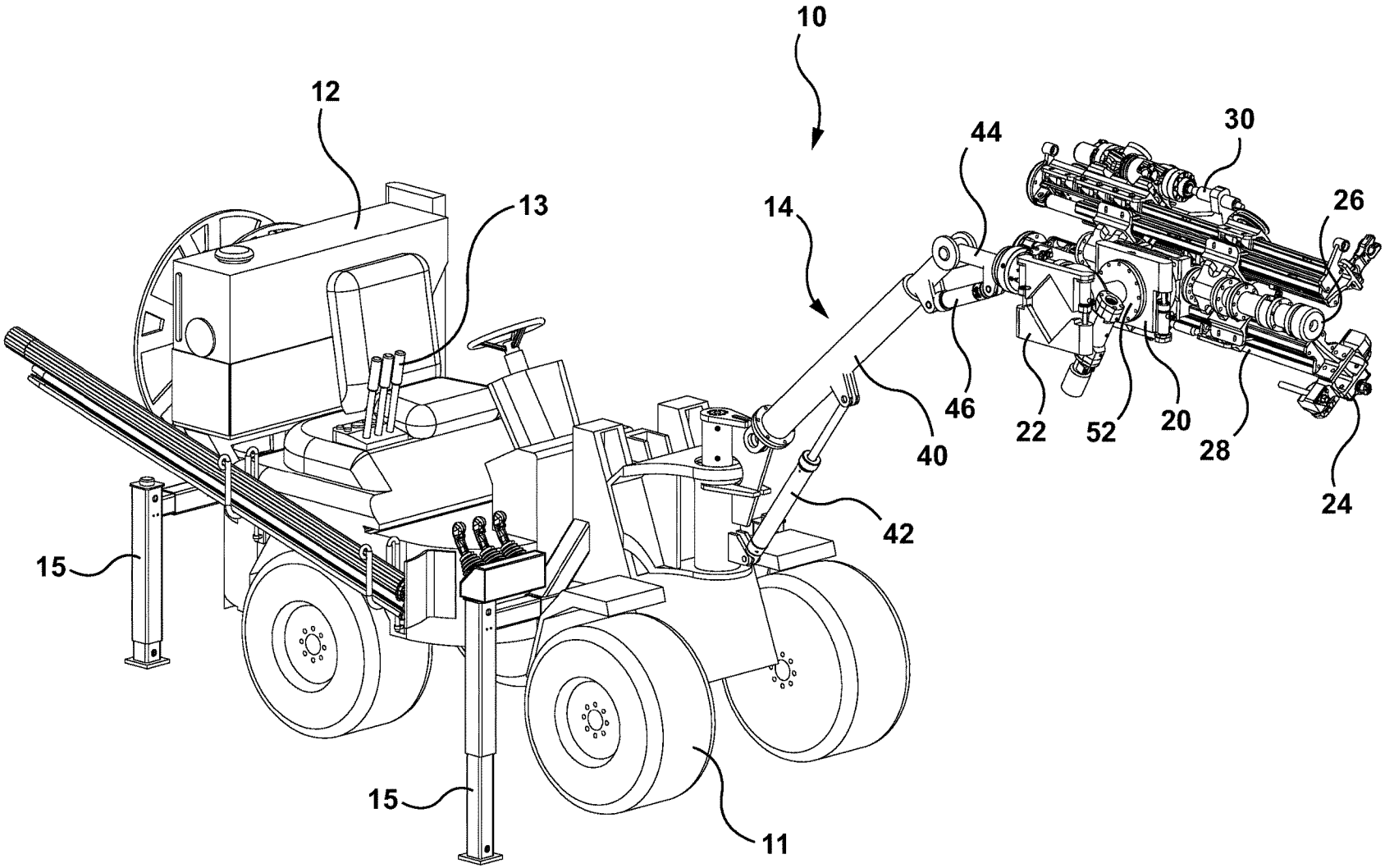
FIG. 6A is an isometric view of the system of FIG. 1 in a bolting configuration with the drill feed assembly detached.
Figure 6B:
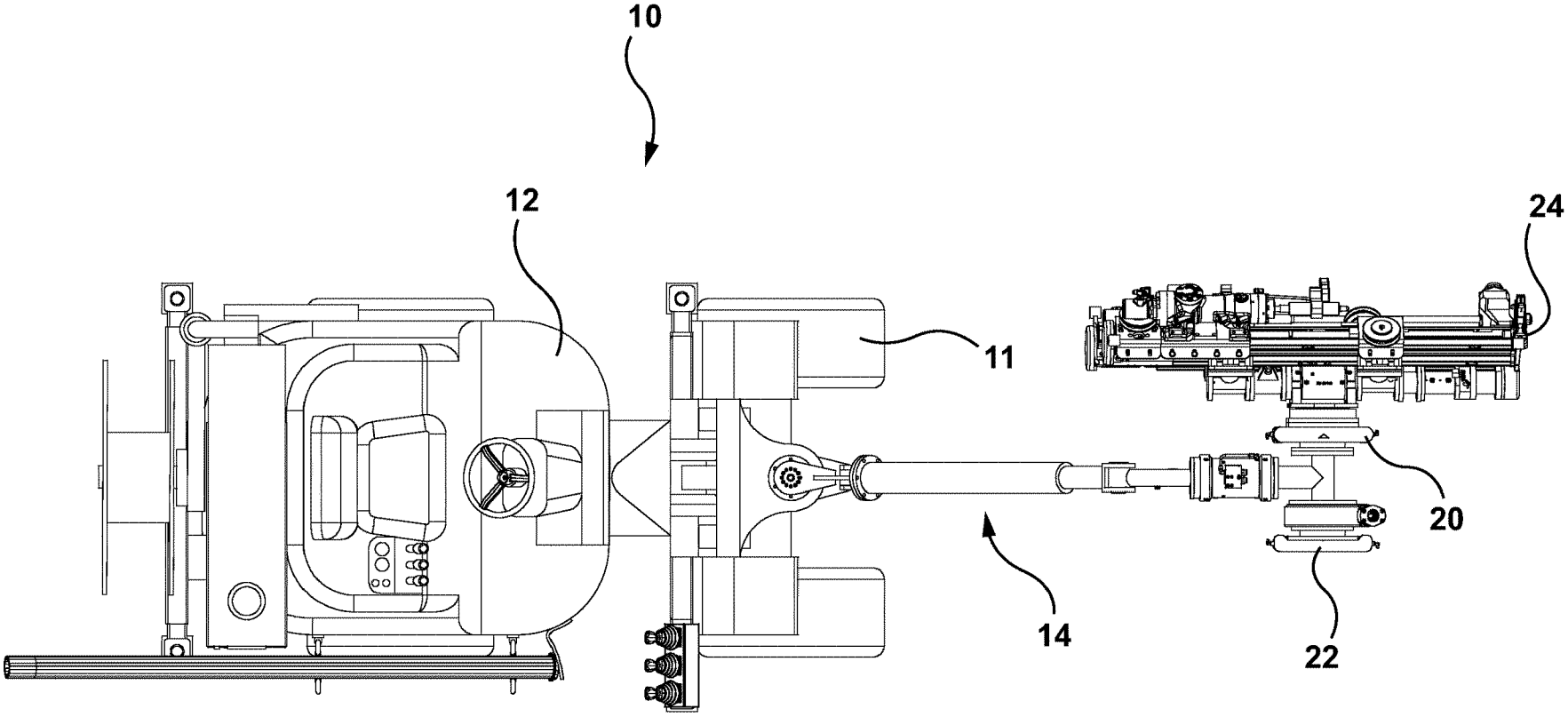
FIG. 6B is a top view of the system of FIG. 1 in the bolting configuration.
Figure 7A:
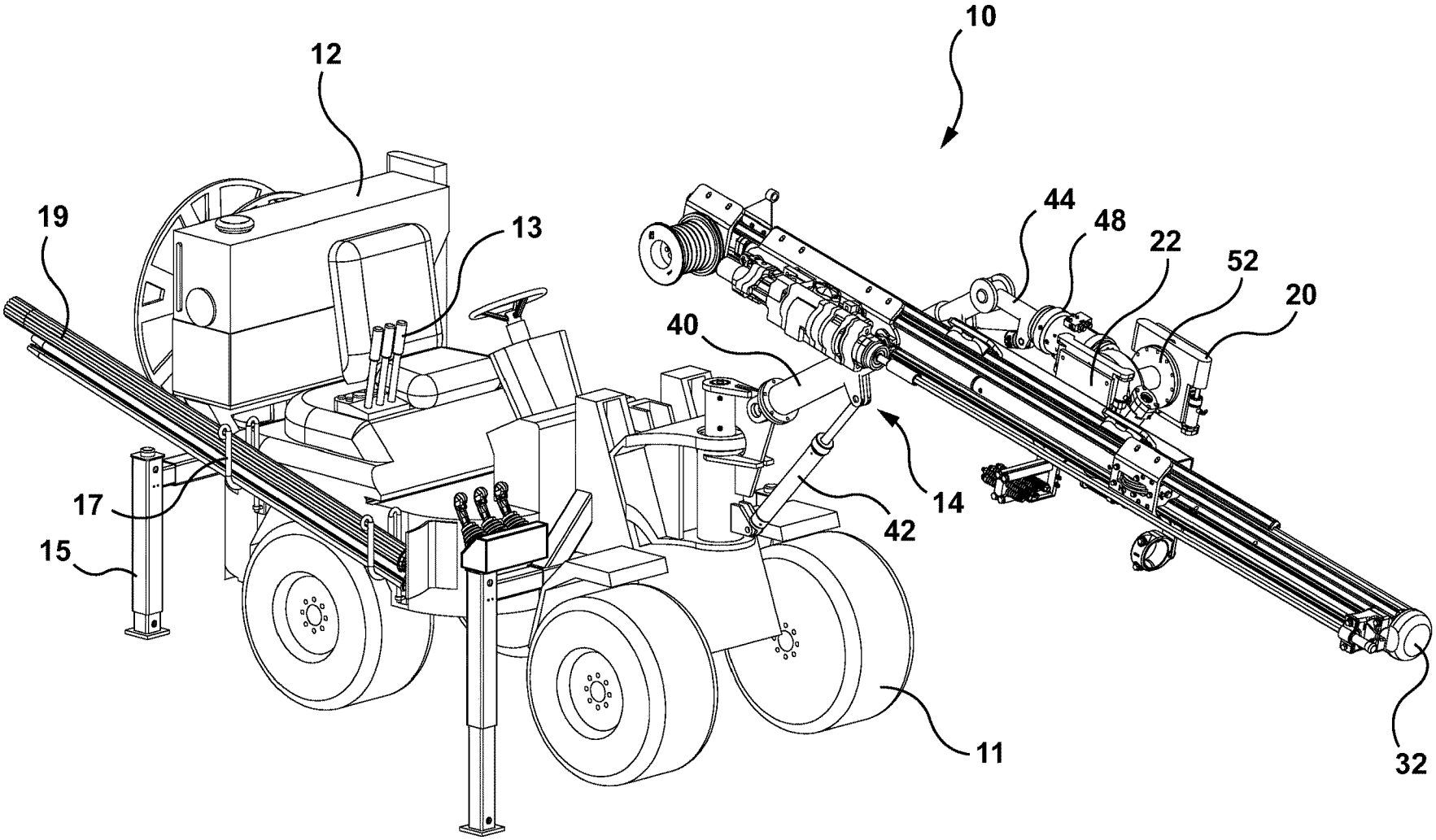
FIG. 7A is an isometric view of the system of FIG. 1 in a drilling configuration with the bolter assembly detached.
Figure 7B:
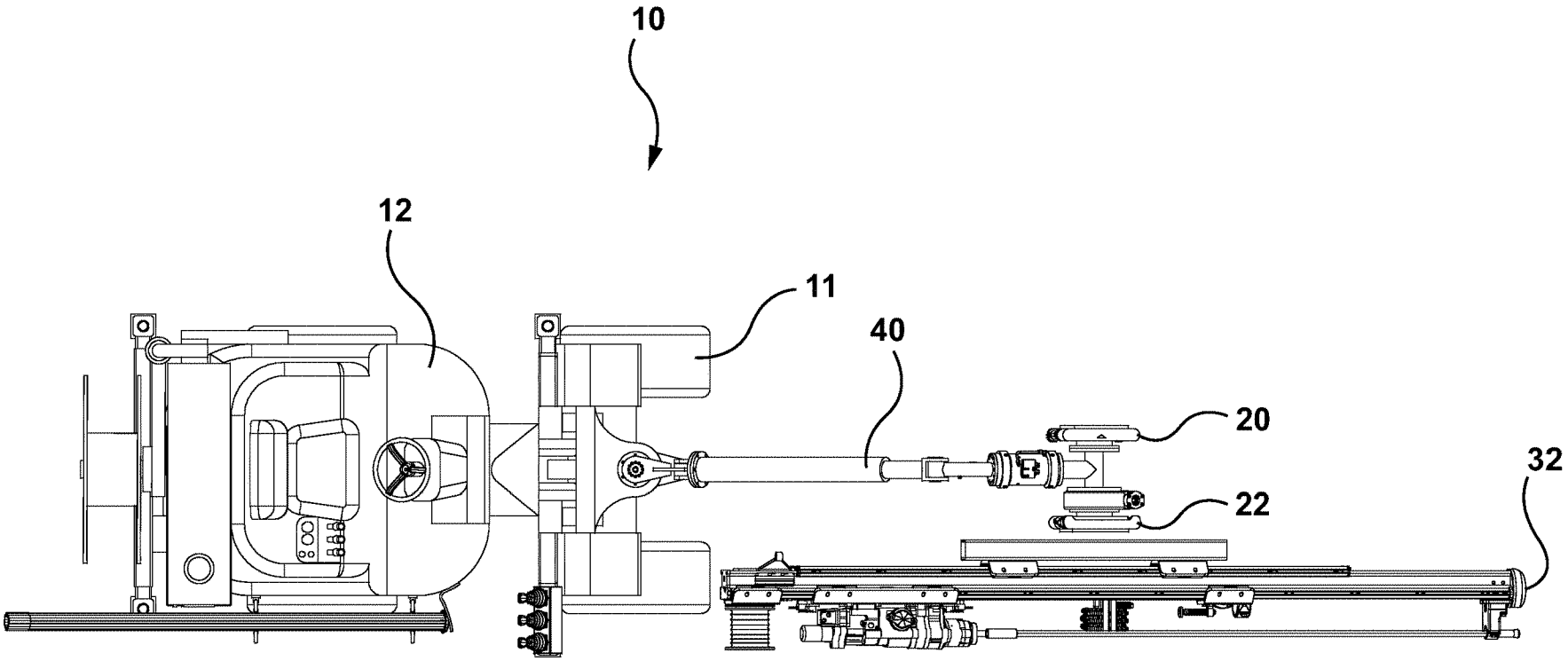
FIG. 7B is a top view of the system of FIG. 1 in the drilling configuration.

By way of introduction, the present invention provides a method of bolting and drilling in an underground mine as well as an integrated bolting and drilling system for underground mining. Although the method and system are particularly useful in a narrow vein of an underground mine where space is limited, it will be appreciated that the present invention may be used generally in a drift in an underground mine and is therefore not limited to narrow vein mining.

A bolting and drilling system 10 in accordance with a first embodiment of the present invention is depicted in FIGS. 1-8F. As depicted in the embodiment of FIGS. 1-8F, the bolting and drilling system 10 includes a vehicle 12 having a plurality of wheels 11. The vehicle 12 illustrated by way of example in the figures is a four-wheeled articulated-chassis vehicle with an open cockpit and a single seat although it will be appreciated that other types or configurations of vehicles may be used, including without limitation autonomous, self-driving or remotely controlled vehicles, etc. The vehicle may be wheeled or tracked or a combination of wheeled and tracked. The vehicle may be gas-powered, diesel-powered, fully electrically powered, or hybrid electric. The vehicle has a plurality of manual controls 13 in the cockpit for manipulating a boom assembly, bolter assembly and drill feed assembly, as will be explained in greater detail below. The vehicle includes a plurality of stabilizers 15 and a bolt carrier 17 for carrying rock bolts 19. The vehicle may also be referred to herein as a carrier unit.

As depicted by way of example in FIGS. 1-8F, the system includes a boom assembly 14 having a first end 16 mounted to the vehicle and a second end 18 having a first quick connector 20 and a second quick connector 22. The system includes a bolter assembly 24 that is connectable to the first quick connector. The bolter assembly includes a stinger 26, a drill 28 and a bolter 30 for respectively stinging, drilling and bolting a roof of a drift an underground mine, for example, but not limited to, a narrow vein of an underground mine. The system also includes a drill feed assembly 32 that is connectable to the second quick connector. The drill feed assembly includes a drill 34 and a drill steel 35 for drilling a rock face of a heading of a drift such as, for example, but not limited to, a narrow vein. In this embodiment, the drilling assembly or drill feed assembly is longer than the bolter assembly. The bolter assembly is shorter than the drilling assembly to permit the bolter assembly to manoeuvre within the confines of a drift or of a narrow vein. The relatively short bolter assembly can thus be oriented to drill and bolt the roof (or side walls) of the drift or narrow vein. The drilling assembly may be longer because it is intended to drill the face of the heading of the drift or narrow vein.

In the embodiment illustrated in FIGS. 1-8F, the drill feed assembly comprises only the drill such that the drill feed assembly has no bolter. In other words, in the illustrated embodiment, the drill feed is used only for drilling holes in the rock face. Explosives are inserted into these holes to blast the rock face to thereby advance the heading. However, in another embodiment, if it is desired to install rock bolts in the rock face, the drill feed assembly may include a bolter and also optionally a stinger.

In the embodiment illustrated by way of example in FIGS. 1-8F, the boom assembly 14 comprises a first boom member 40 connected at a proximal end to the vehicle and adjustable in pitch by a first boom actuator 42 connected between the vehicle and the first boom member. The boom assembly 14 also includes a second boom member 44 connected at a proximal end to a distal end of the first boom member and adjustable in pitch relative to the first boom member by a second boom actuator 46 connected between the first boom member and the second boom member. The boom assembly includes a rotary motor 48 connected at a distal end of the second boom member and rotatable about an axis aligned with the second boom member. The boom assembly further includes a T-shaped support member 50 connected to a distal end of the rotary motor. The T-shaped support member includes a first flange 52 for connecting to a first plate and includes a second flange 54 for connecting to a second plate. The boom assembly also includes a hydraulically powered rotary motor 55 for rotating the T-shaped support member.

Figure 8C:
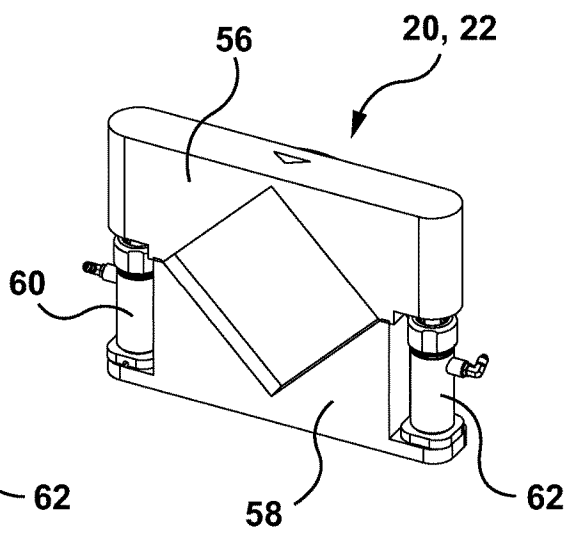
FIG. 8C is an isometric view of the quick connector of FIG. 8A shown in a closed position.
Figure 8B:
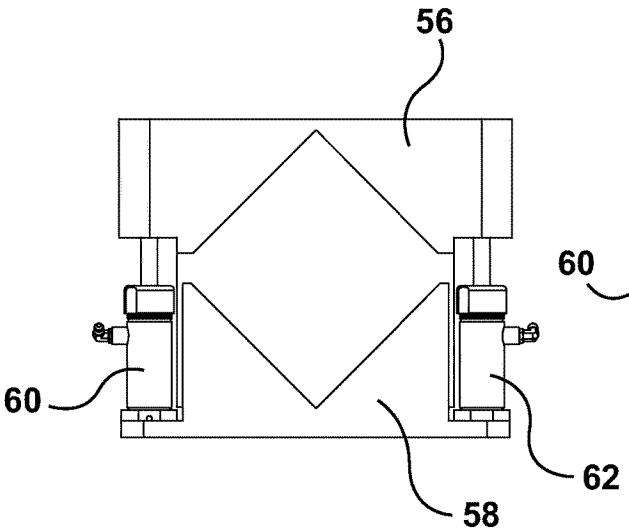
FIG. 8B is a front view of the quick connector of FIG. 8A shown in the open position.
Figure 8A:
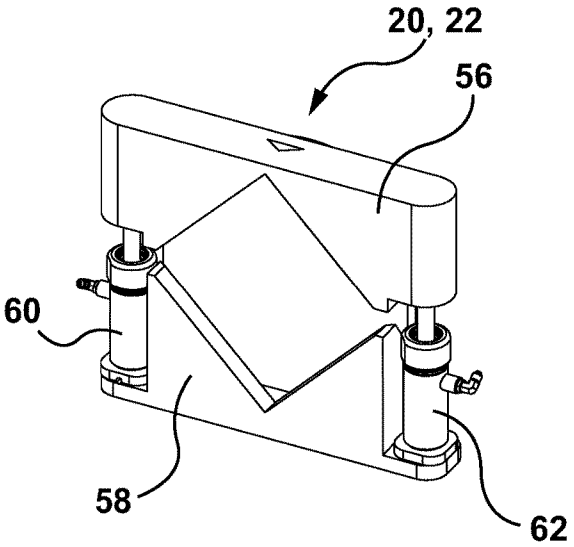
FIG. 8A is an isometric view of a quick connector used in the system of FIG. 1, in which the quick connector is shown in an open position.
Figure 8F:
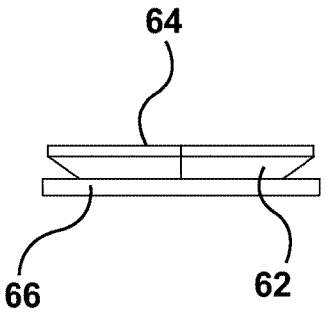
FIG. 8F is a side view of the plate of FIG. 8E.
Figure 8E:
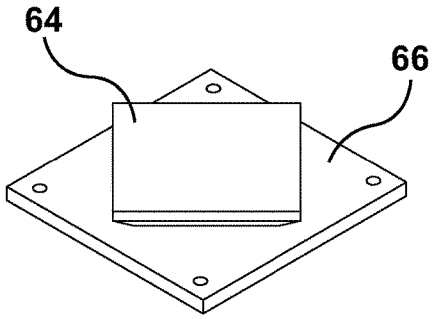
FIG. 8E is an isometric view of a plate for connecting to the quick connector of FIG. 8A.
Figure 8D:
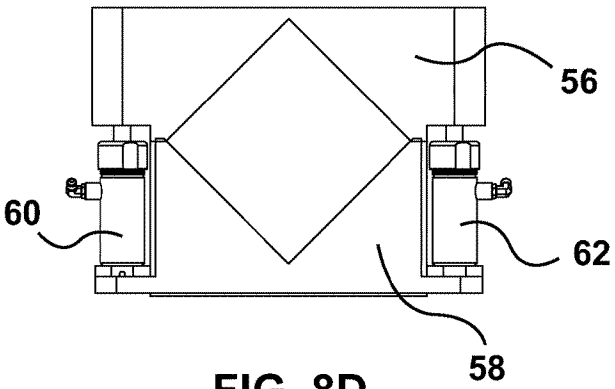
FIG. 8D is a front view of the quick connector of FIG. 8A shown in the closed position.

As illustrated by way of example in FIGS. 8A-8F, each of the first and second quick connectors 20, 22 may take the form of a plate holder composed of an upper plate member (or upper holder component) 56 and a lower plate member (or lower holder component) 58. The upper and lower plate members are movable by a pair of parallel linear actuators 60, 62. The upper and lower plate members 60, 62 cooperate to receive and hold an attachment plate 64. One such attachment plate (i.e. a first plate) is attached to the bolter assembly and another identical attachment plate (i.e. a second plate) is attached to the drill feed assembly to enable quick connection of the bolter assembly or drill feed assembly to the boom assembly. As shown by way of example in FIGS. 8E-8F, the attachment plate is a square plate mounted at a 45-degree angle to a larger square adapter plate 66 having a hole in each corner for receiving a fastener enabling the quick connectors to be fastened to a flange or other portion of the drill feed assembly or bolter assembly. As shown in FIG. 8F, the attachment plate 64 is mounted to the adapter plate 66 by a bevelled portion to enable the plate holder to properly grip the attachment plate. In this illustrated embodiment, the first quick connector 20 comprises a first plate holder for receiving a first plate which is attached to the bolter assembly whereas the second quick connector 22 comprises a second plate holder for receiving a second plate which is attached to the drill feed assembly. These plate holders and respective plates thus act as quick connectors to enable quick connection of the bolter assembly and drill feed assembly to the boom assembly.

The parallel linear actuators 60, 62 shown in FIGS. 8A-8D may be hydraulic or pneumatic. Alternatively, the actuators 60, 62 may be replaced by any suitable electrically powered device (either through a wireless or wireline connection) or manually powered mechanism. In the illustrated embodiment, the plates are square and the plate holders define a square-shaped holding space when closed. Another shape may be used.

In one embodiment, the system includes a master controller for operating both the first and second quick connectors by simultaneously powering all of the actuators. In other embodiments, the actuators of the first quick connector may be independently controlled from those of the second quick connector.

FIG. 8 depicts the system in a bolting configuration with the drill feed assembly detached. In the bolting configuration, only the bolter assembly is attached to the boom assembly.

Figure 9:
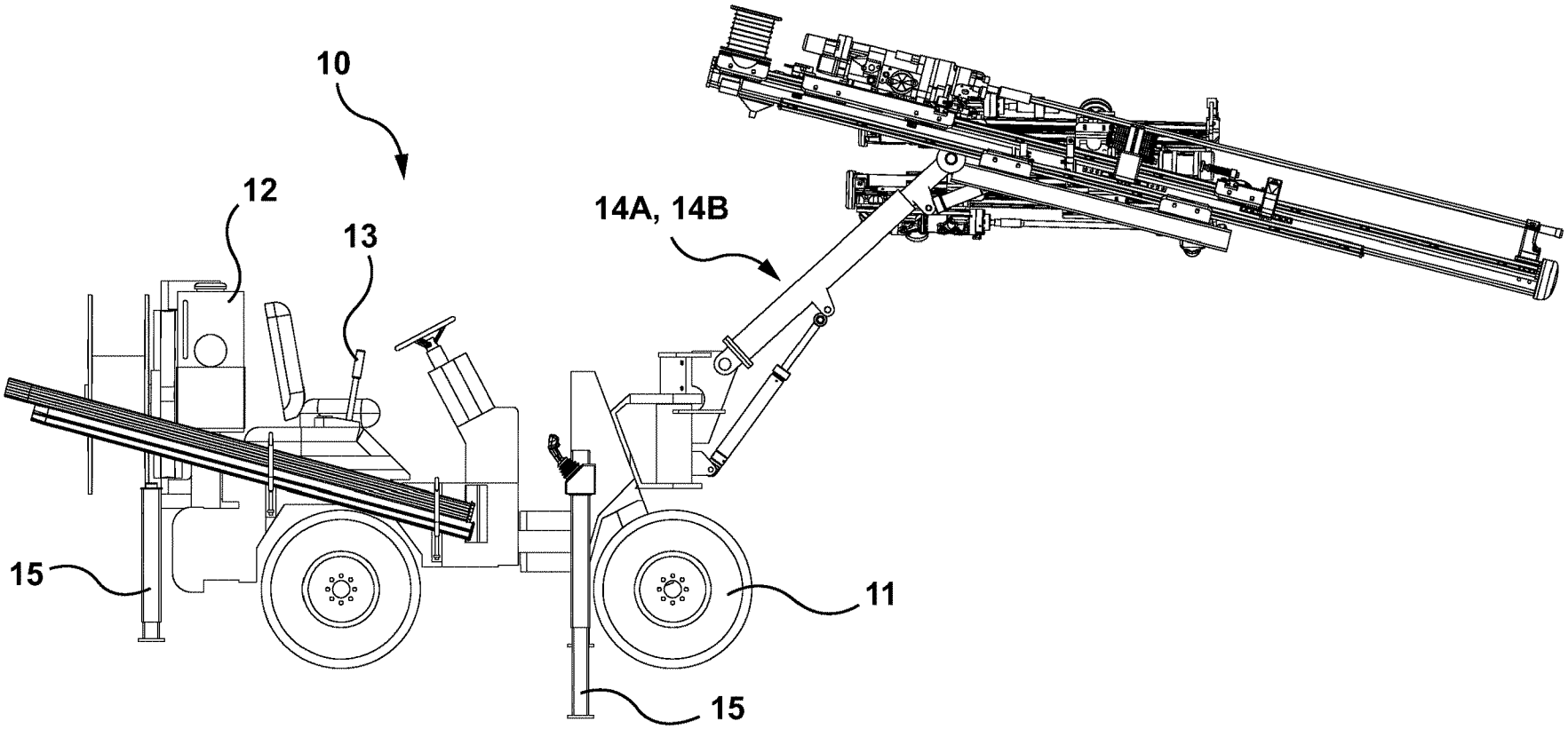
FIG. 9 is a side view of the bolting and drilling system having dual booms in accordance with a second embodiment of the present invention.

FIG. 9 depicts the system in a drilling configuration with the bolter assembly detached. In the drilling configuration, only the drill feed assembly is attached to the boom assembly.

Figure 10:
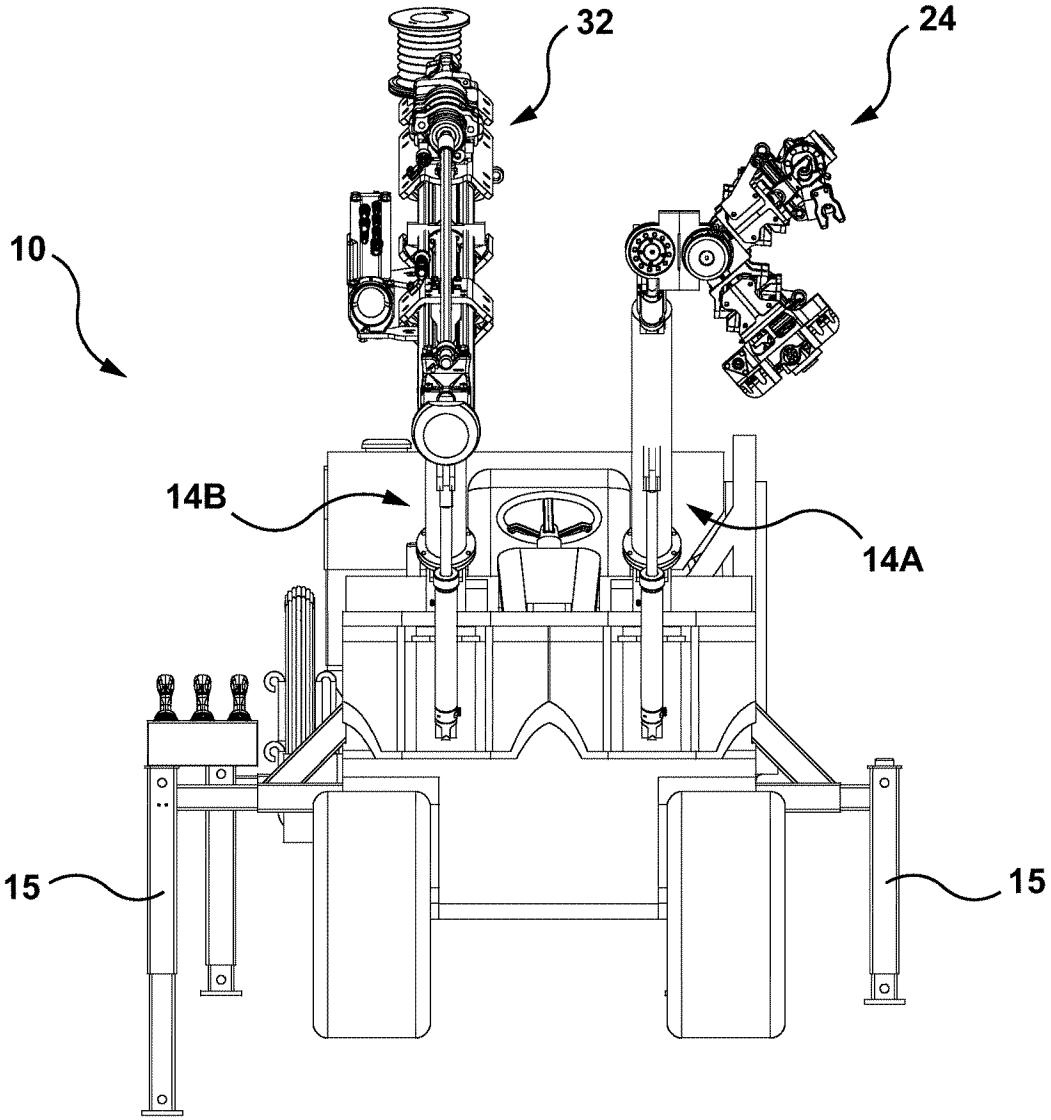
FIG. 10 is a front view of the system of FIG. 9.
Figure 11:
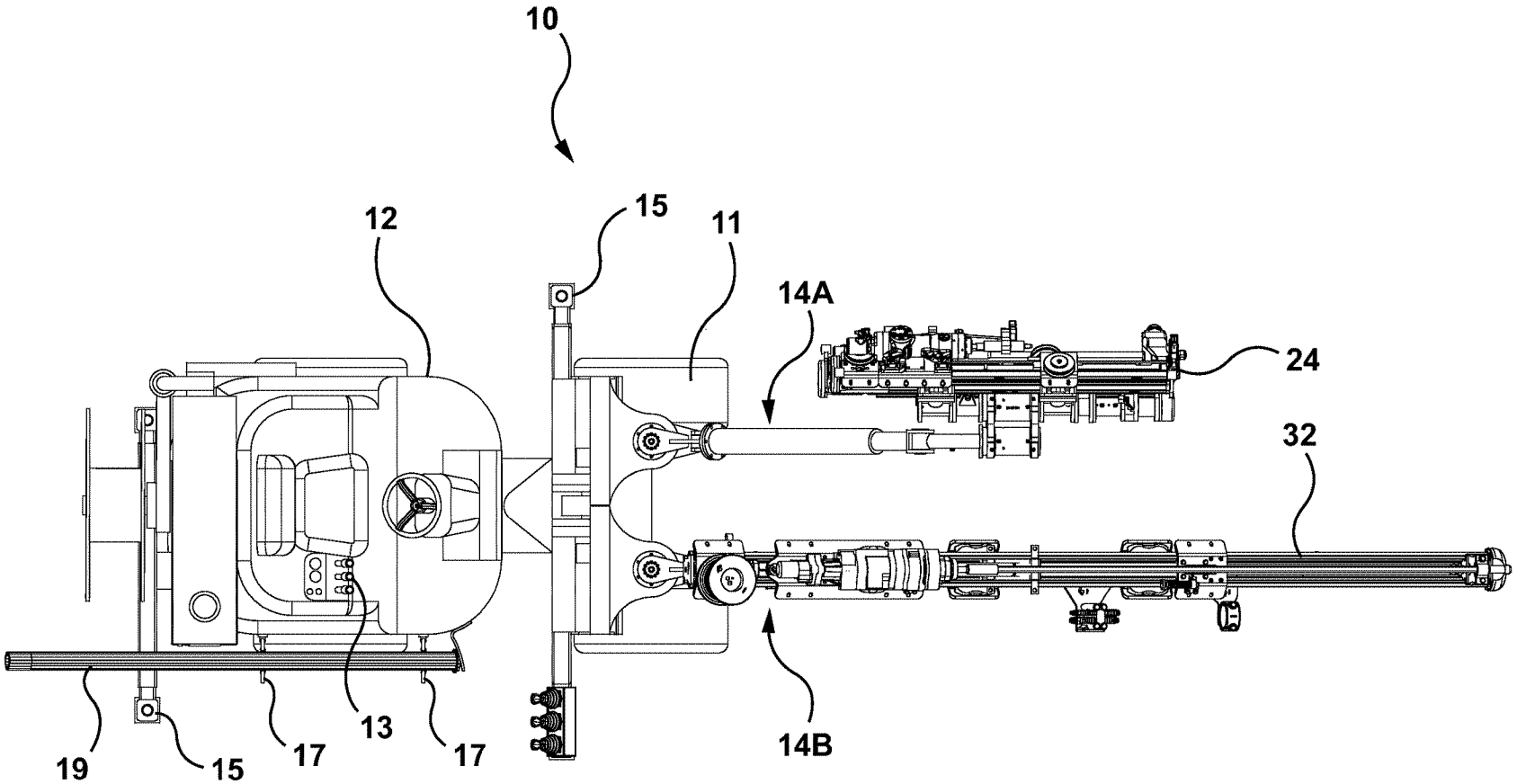
FIG. 11 is a top view of the system of FIG. 9.
Figure 12:
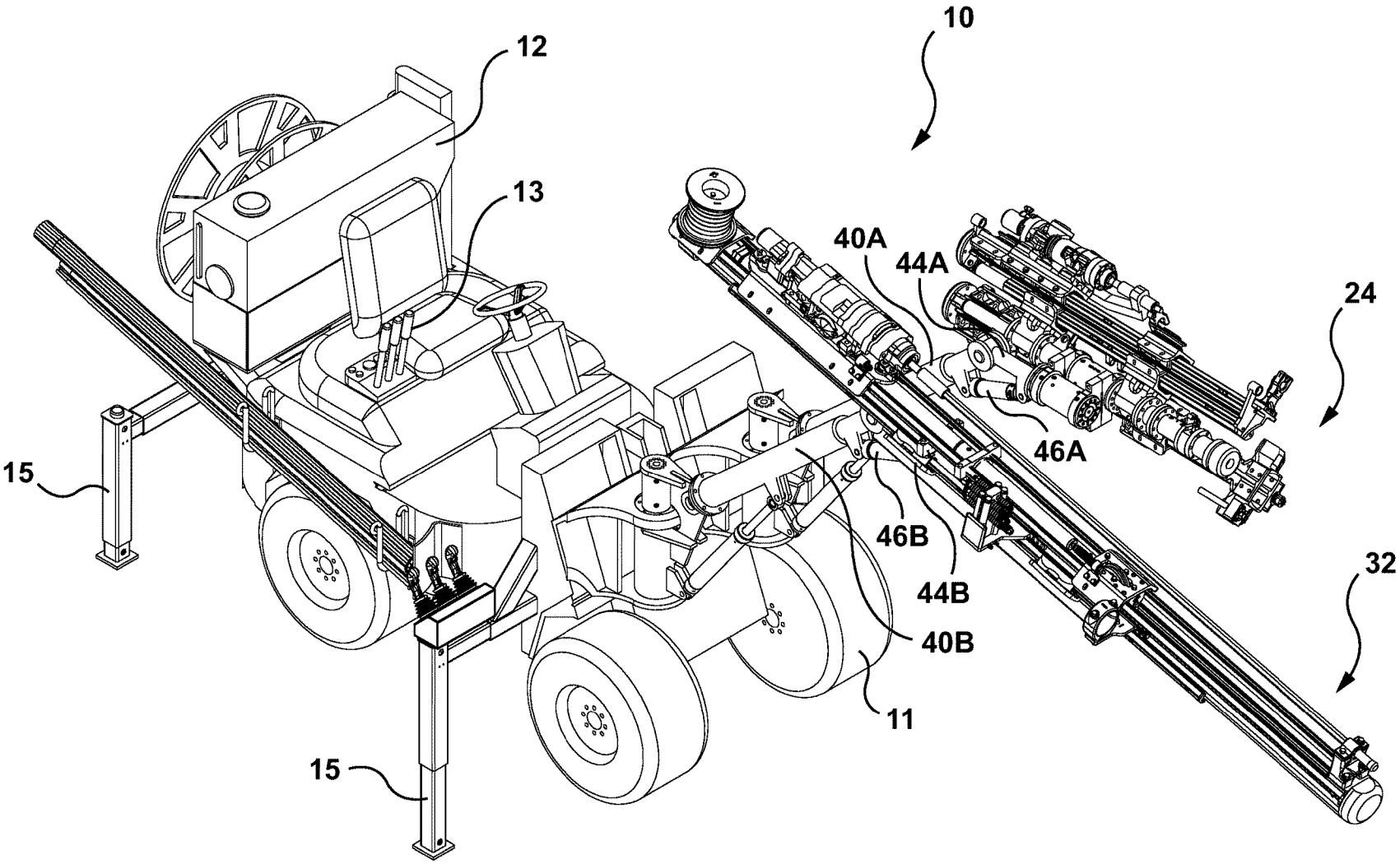
FIG. 12 is an isometric view of the system of FIG. 9.
Figure 13:
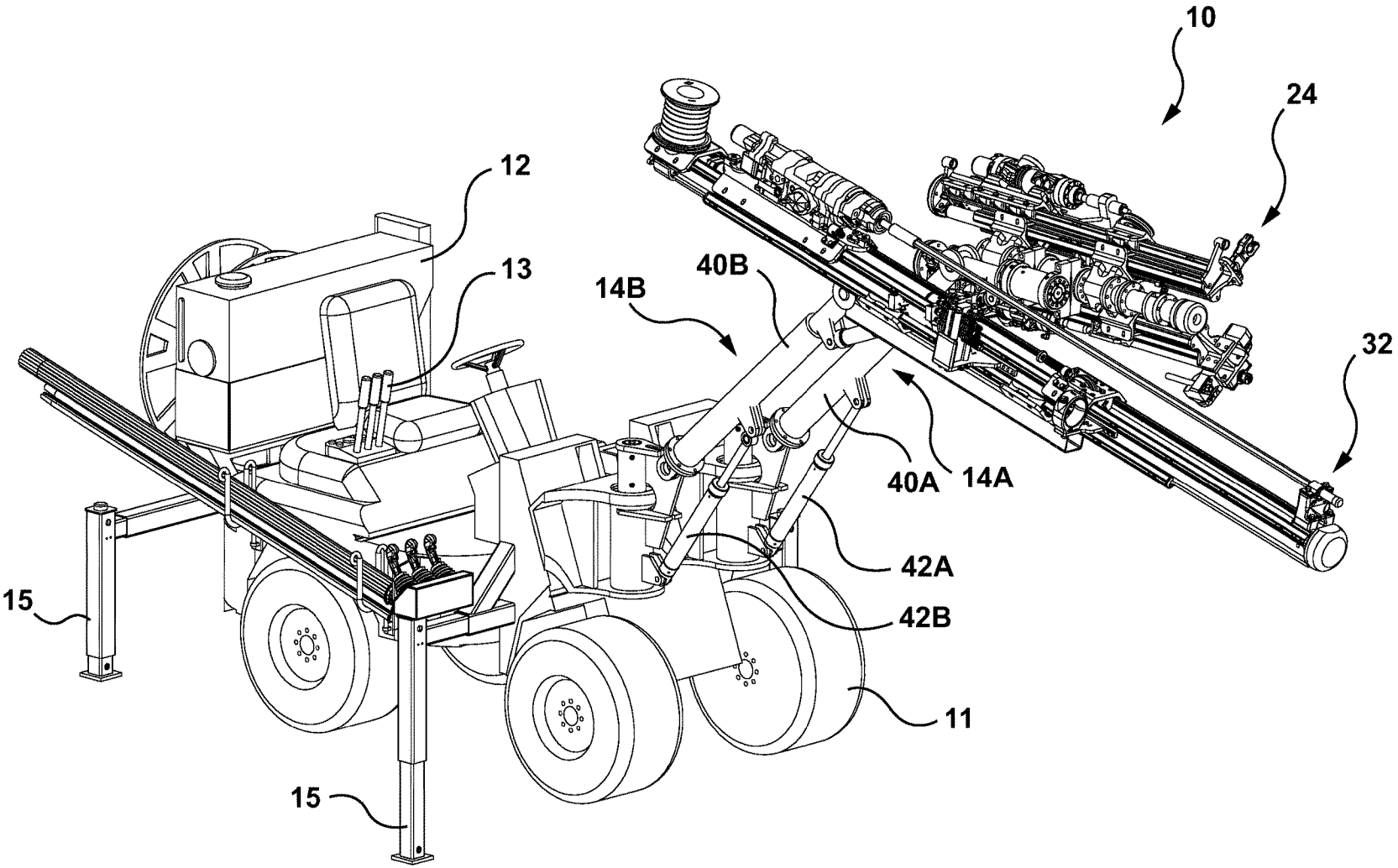
FIG. 13 is a dimetric view of the system of FIG. 9.
Figure 14A:
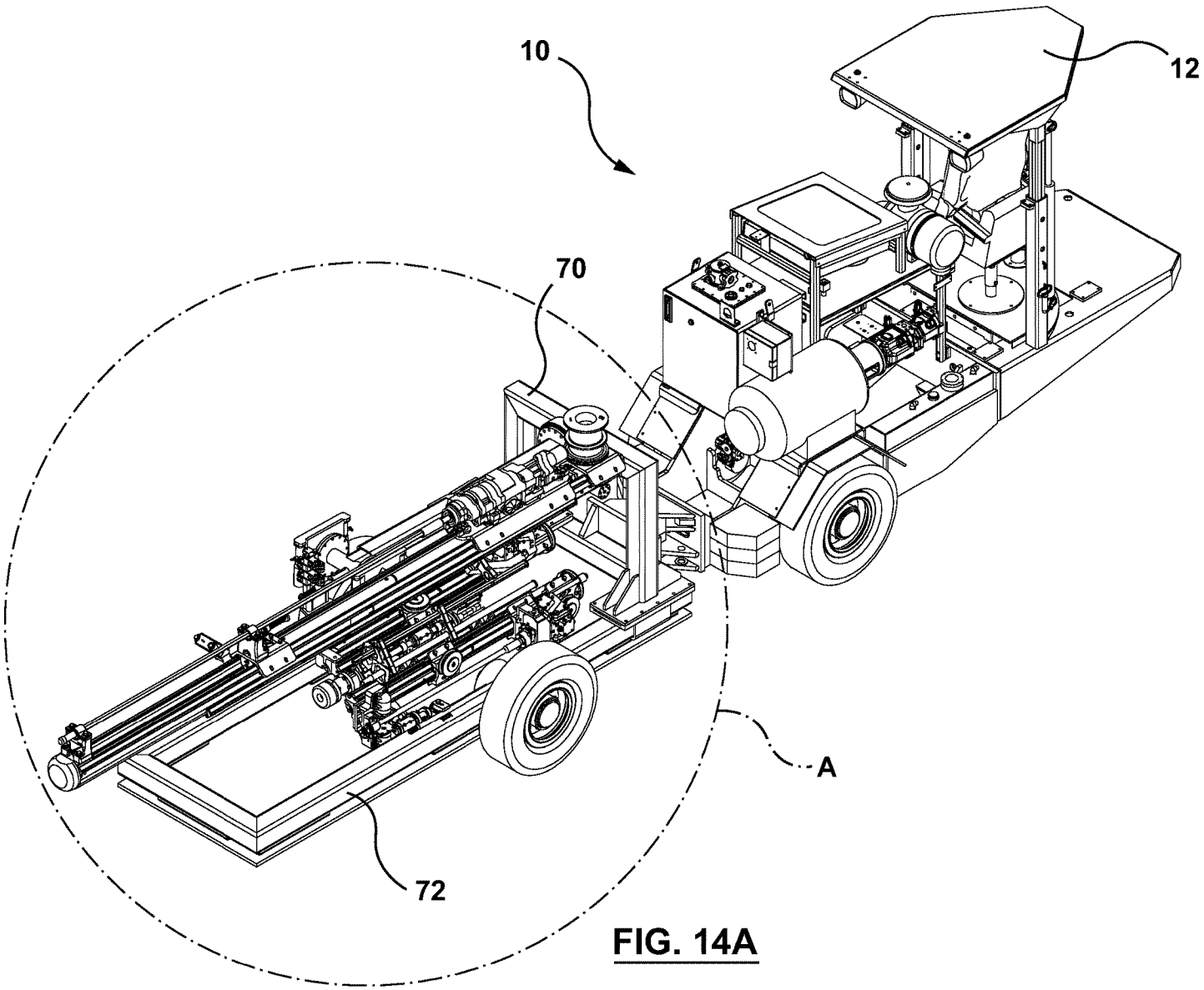
FIG. 14A is an isometric view of a system having a gantry in accordance with a third embodiment, showing the gantry in a retracted position and drill feed assembly loaded for drilling.
Figure 14B:
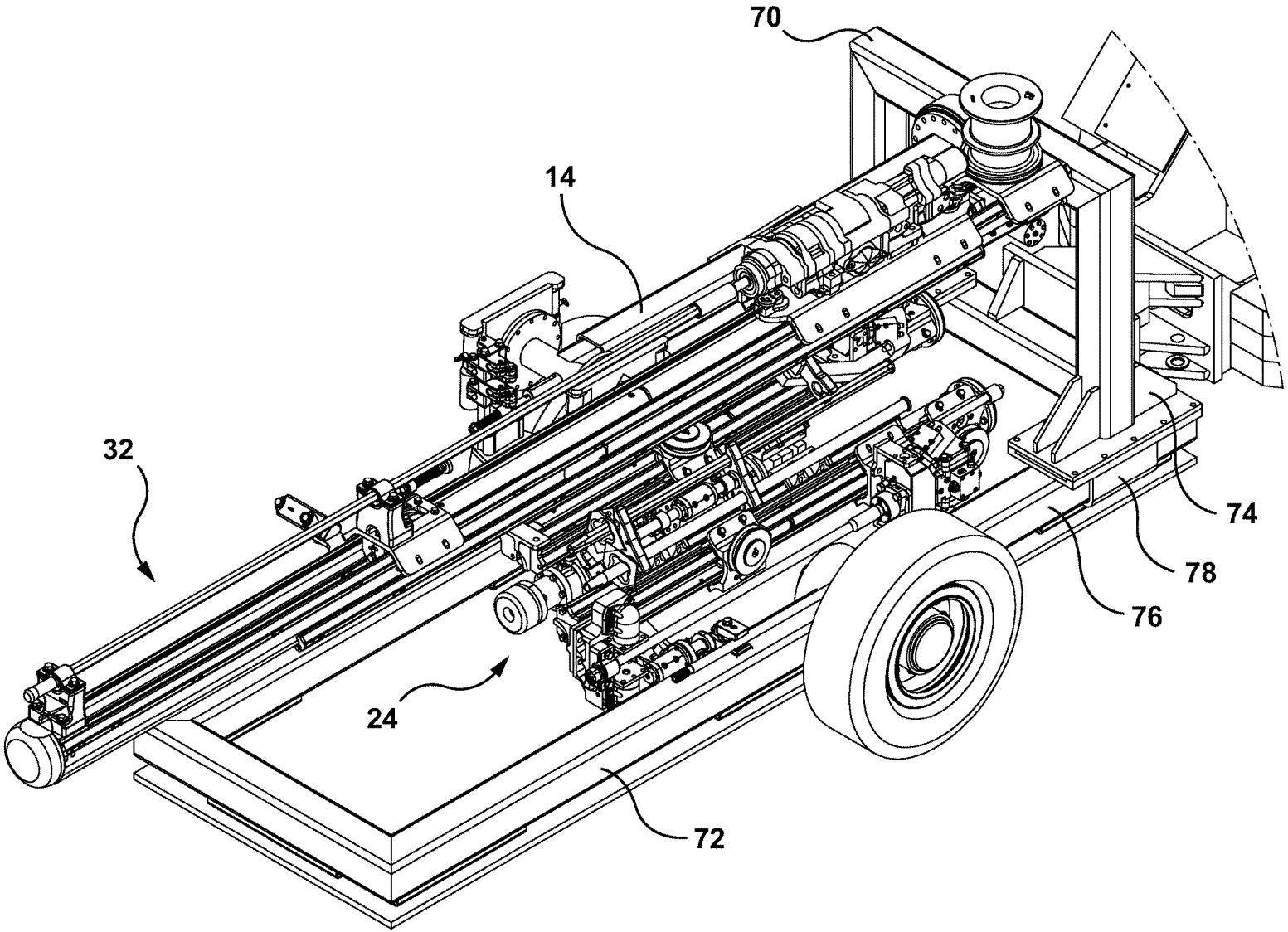
FIG. 14B is an enlarged isometric view of the gantry shown at region A of FIG. 14A.
Figure 15A:
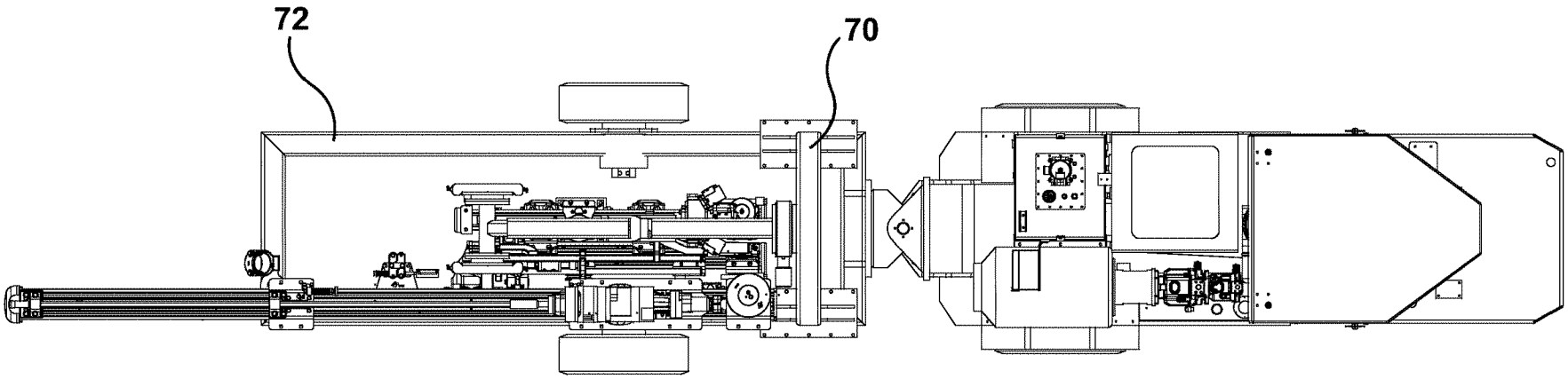
FIG. 15A is a top view of the system of FIG. 14A.
Figure 15B:
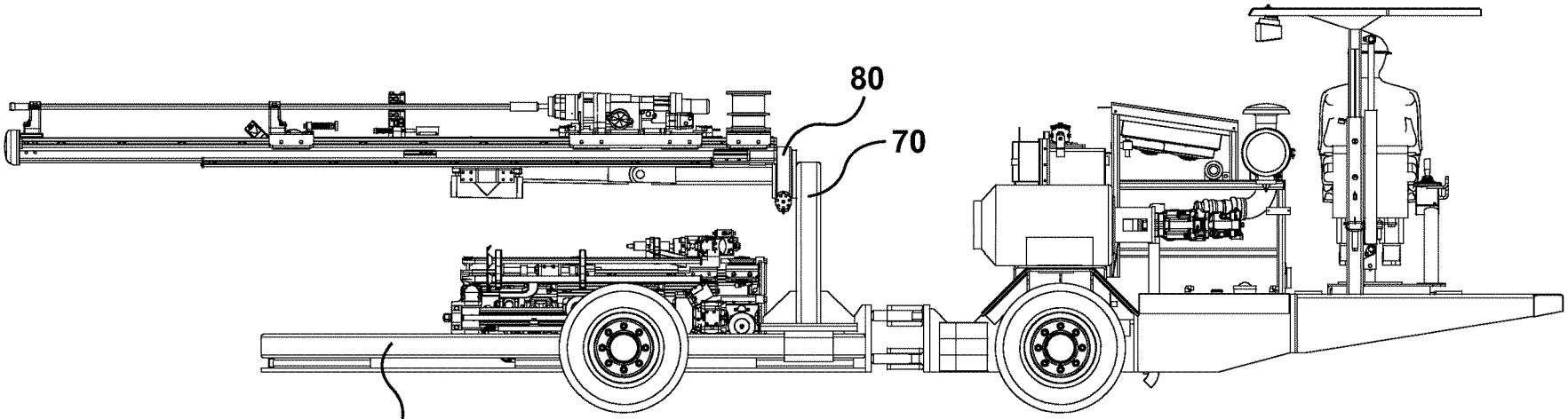
FIG. 15B is a side view of the system of FIG. 14A.
Figure 16A:
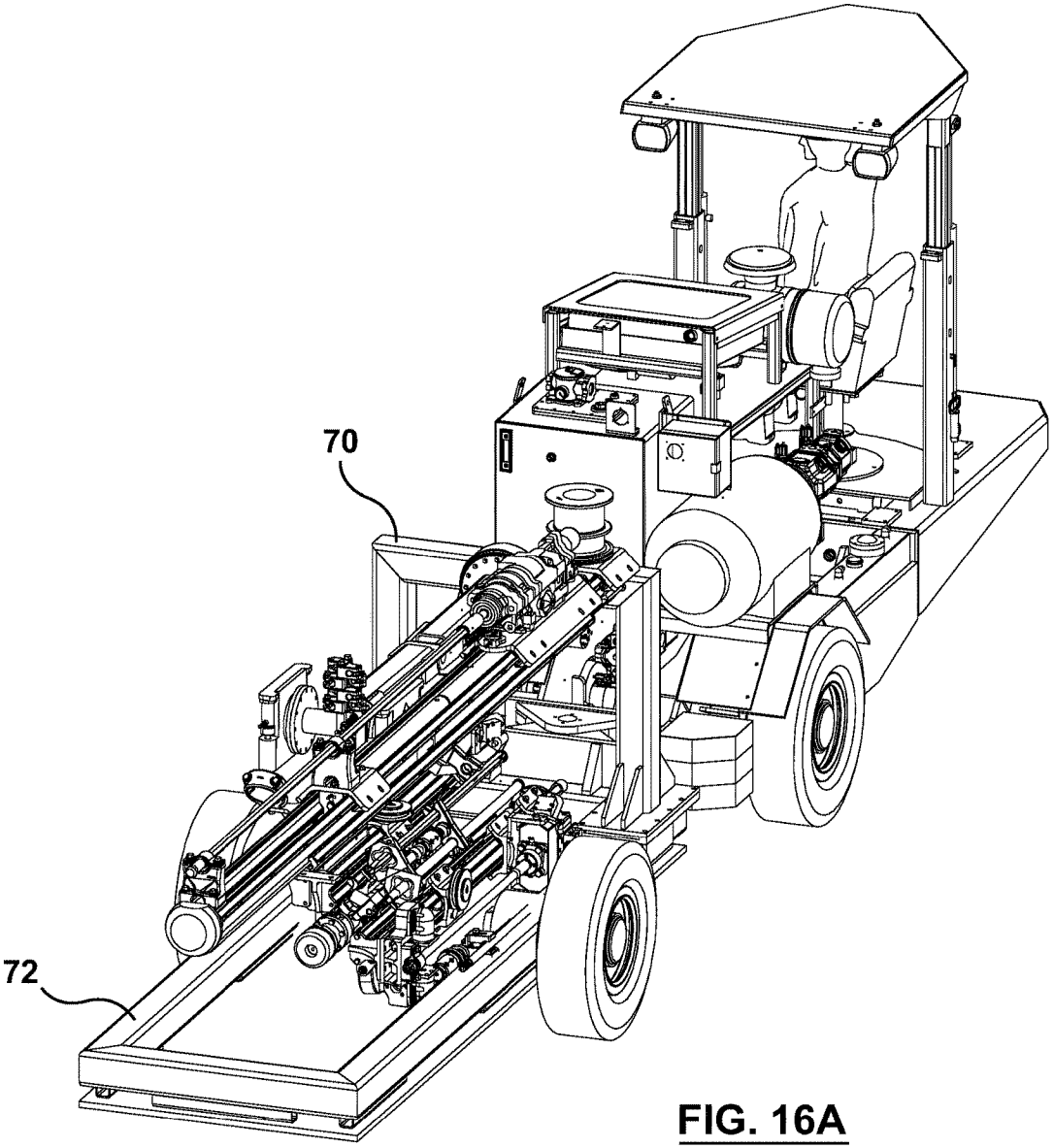
FIG. 16A is a dimetric view of the system of FIG. 14A.
Figure 16B:
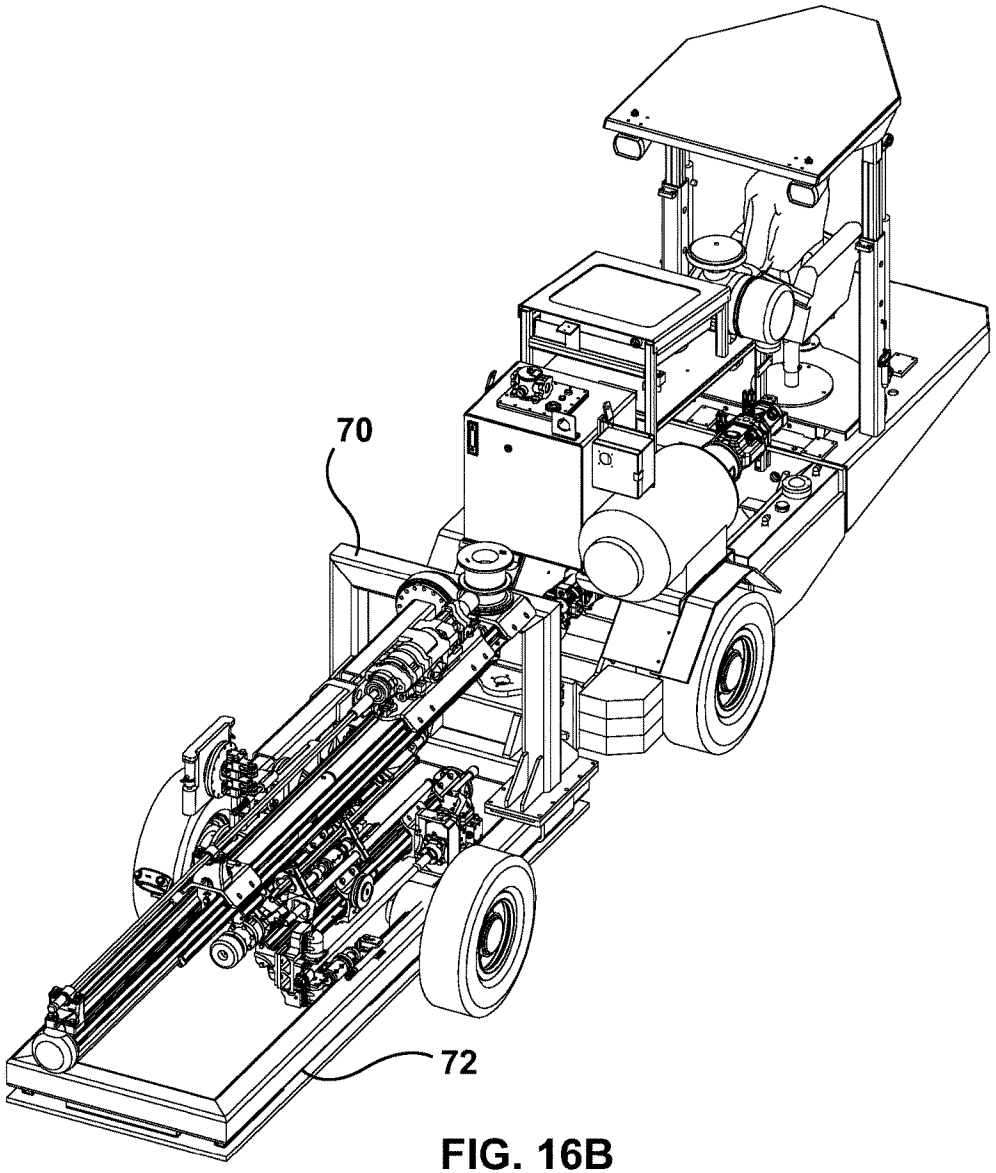
FIG. 16B is a trimetric view of the system of FIG. 14A.
Figure 17A:
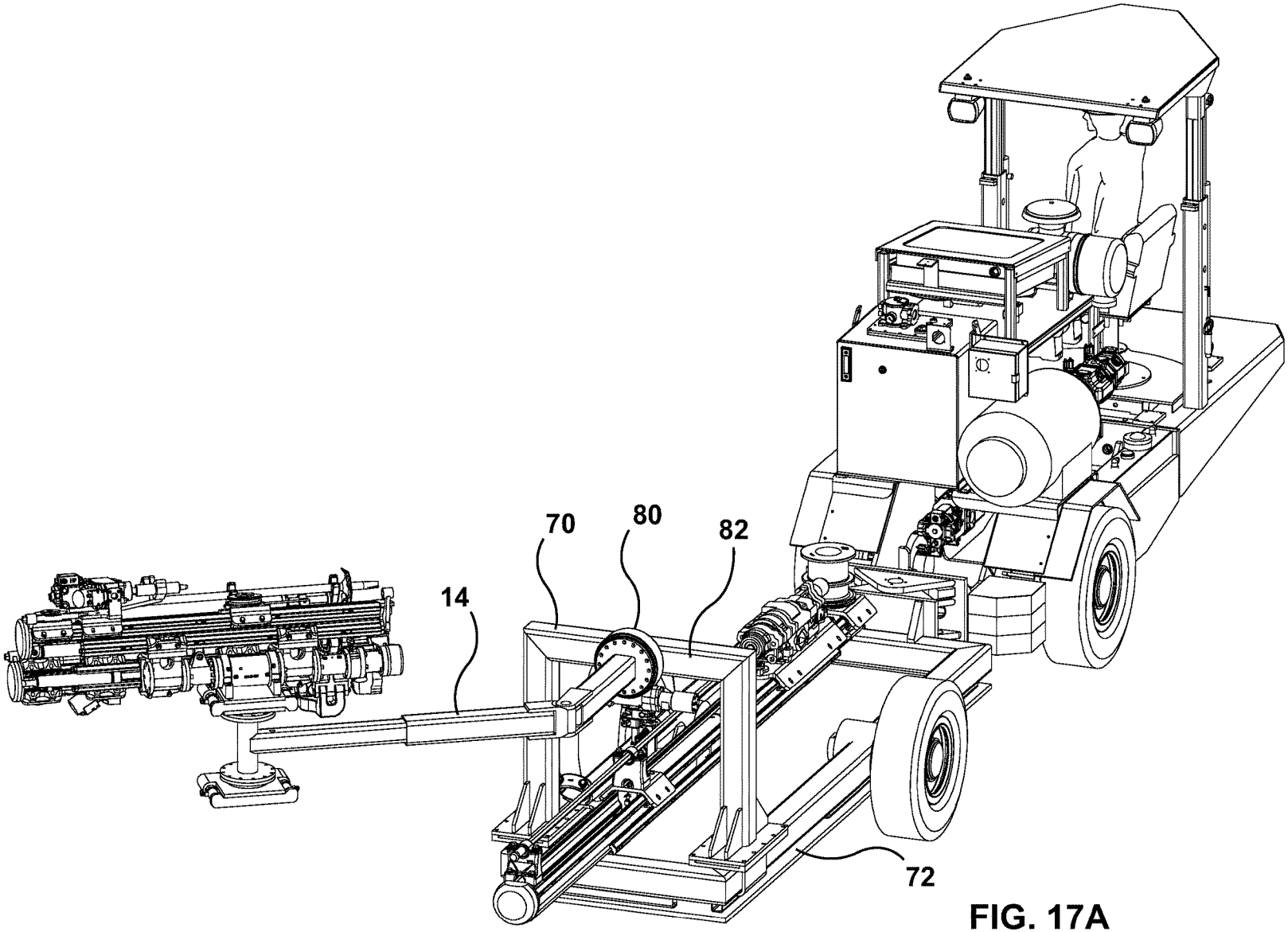
FIG. 17A is a dimetric view of the system of FIG. 14A wherein the gantry is shown in an extended position and the bolter assembly is loaded for bolting.
Figure 17B:
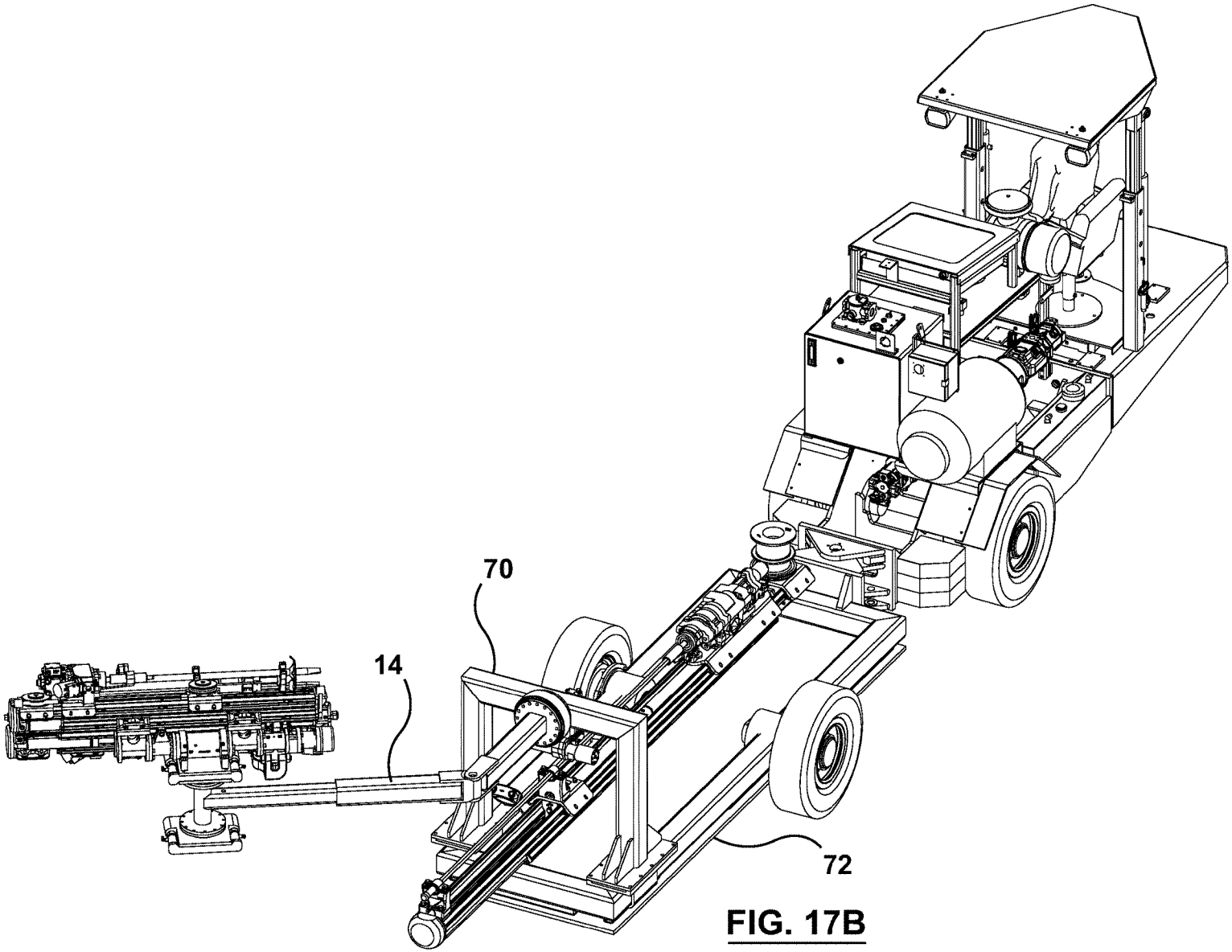
FIG. 17B is a trimetric view of the system of FIG. 14A wherein the gantry is also shown in the extended position with the bolter assembly ready for bolting.
Figure 18A:
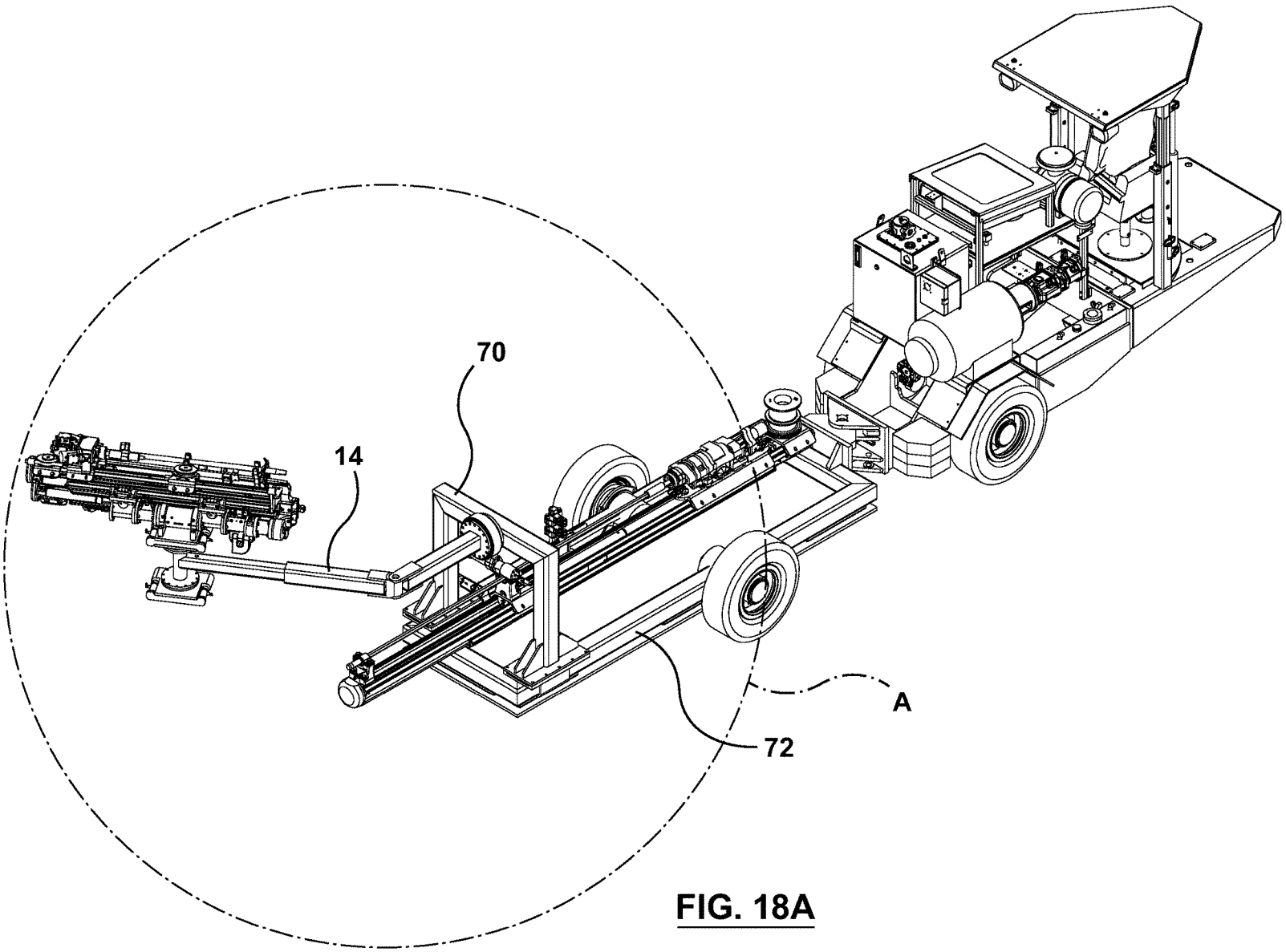
FIG. 18A is an isometric view of the system of FIG. 14A wherein the gantry is also shown in the extended position with the bolter assembly ready for bolting.
Figure 18B:
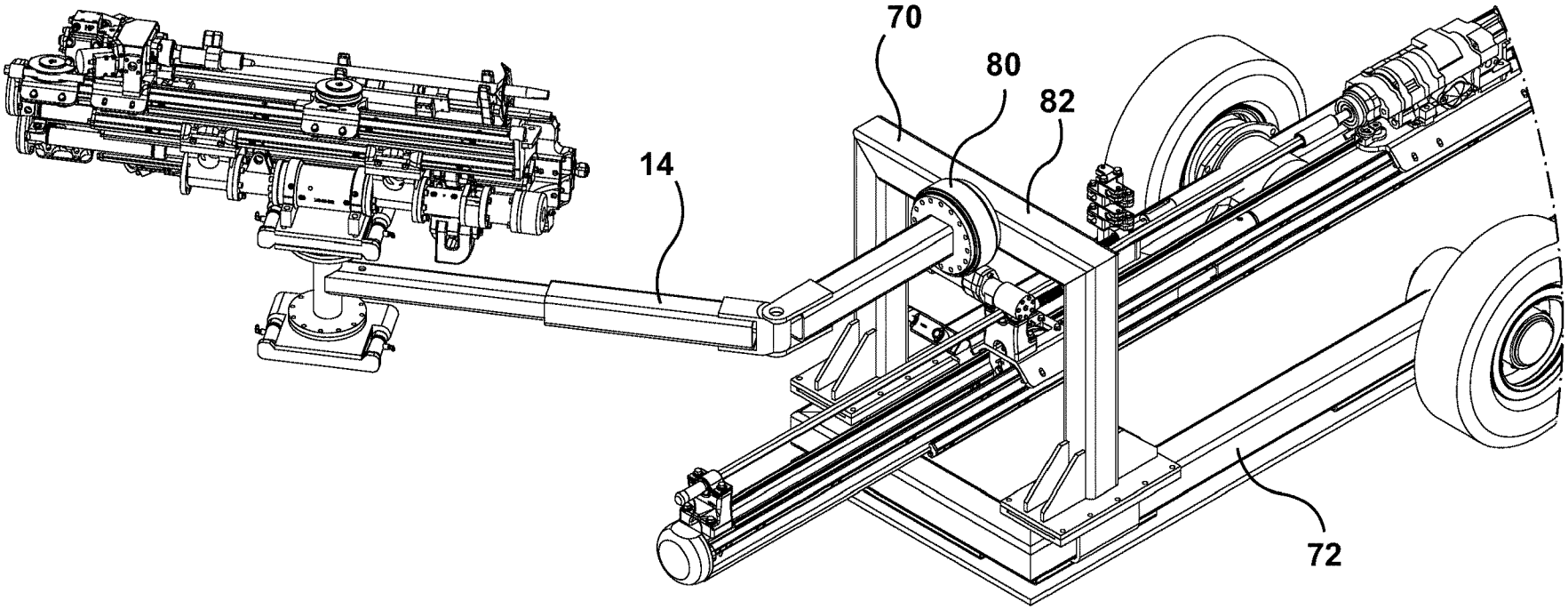
FIG. 18B is an enlarged isometric view of the gantry and bolter assembly shown at region A of FIG. 18A.
Figure 19A:
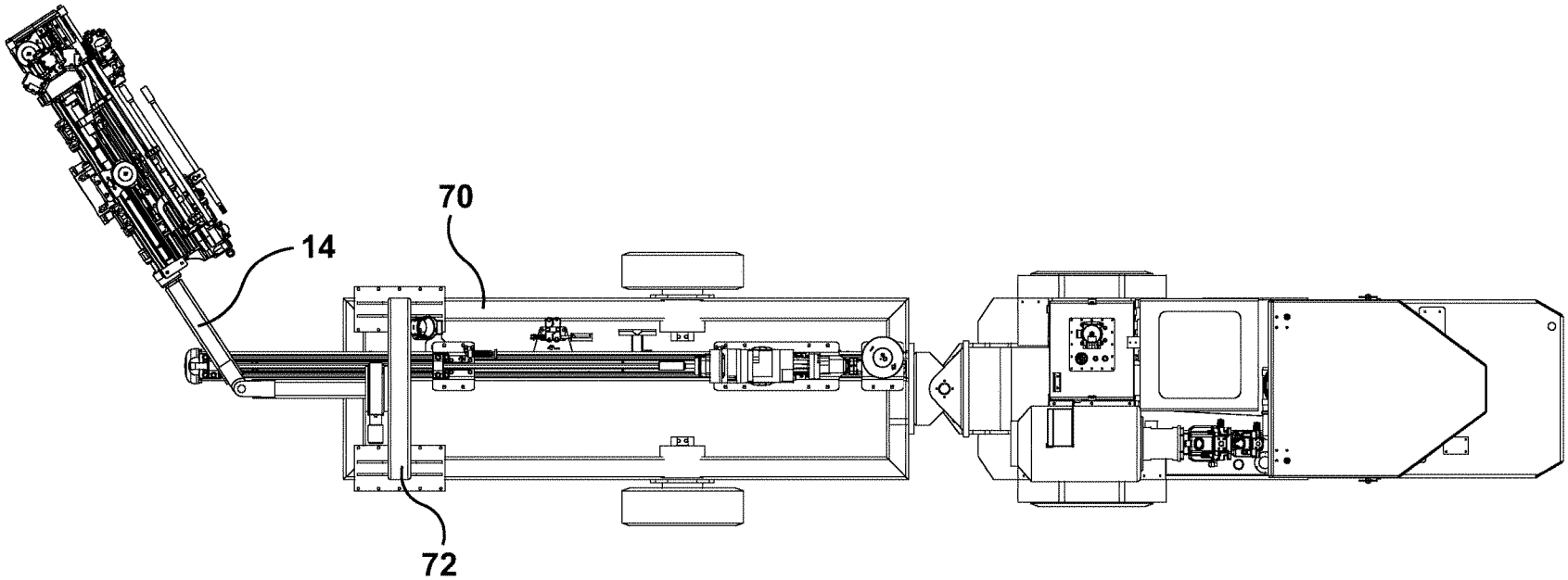
FIG. 19A is a top view of the system of FIG. 18A.
Figure 19B:
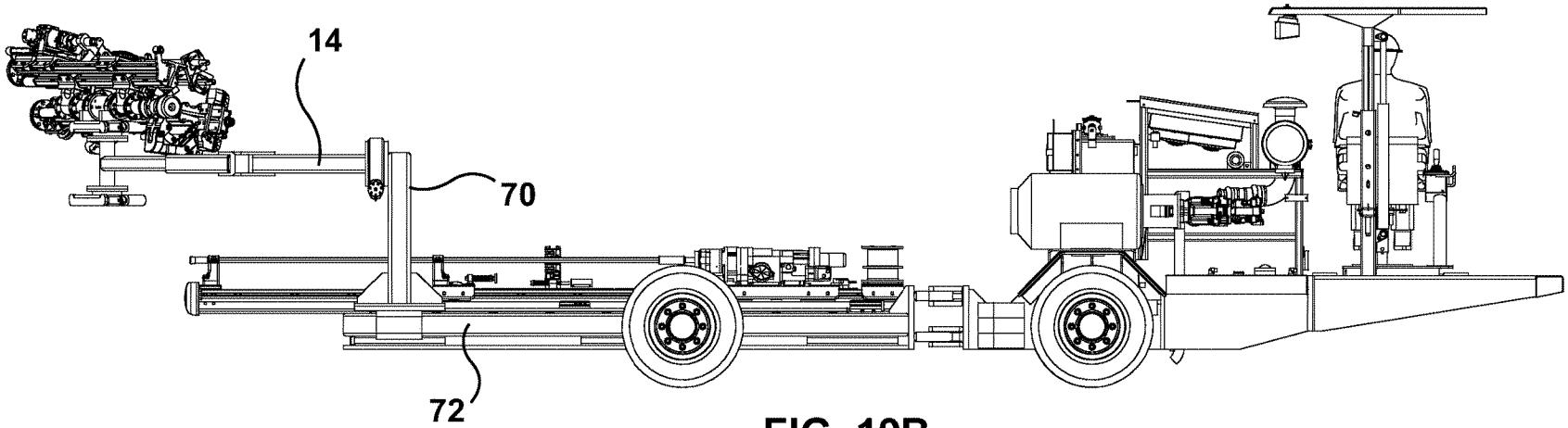
FIG. 19B is a side view of the system of FIG. 18A.
Figure 20A:
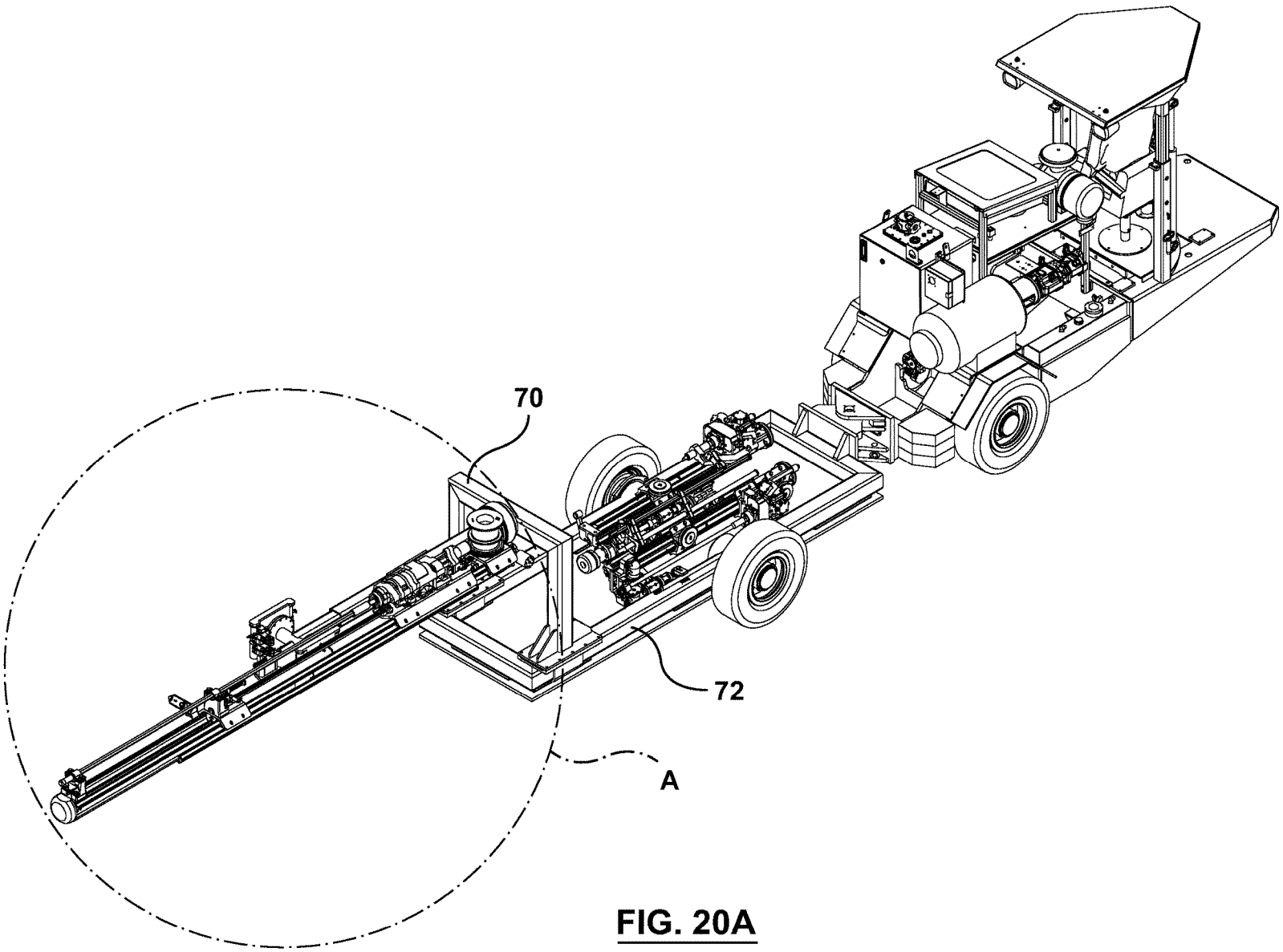
FIG. 20A is an isometric view of the system of FIG. 14A showing the gantry in the extended position and with the drill feed assembly loaded for drilling.
Figure 20B:
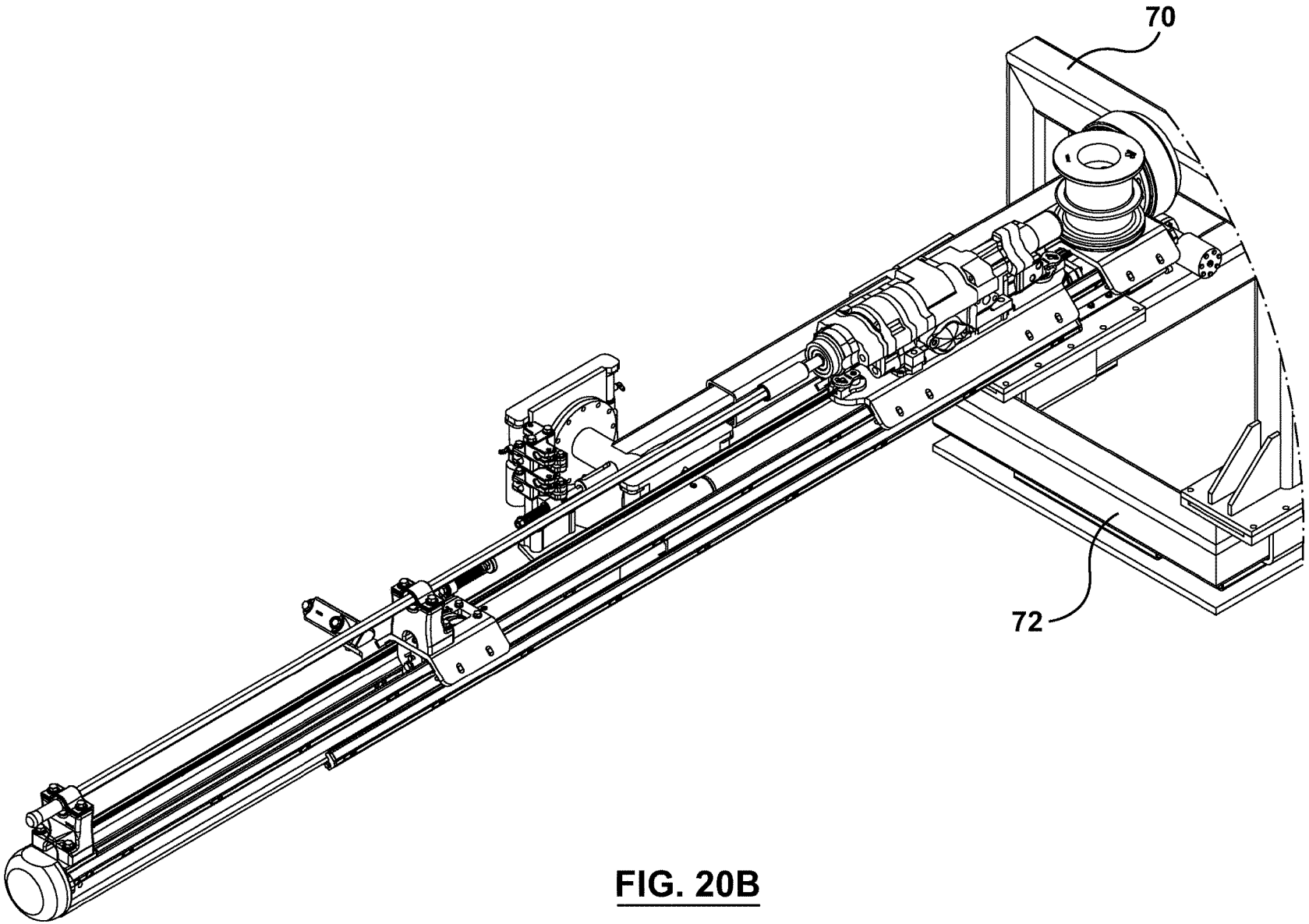
FIG. 20B is an enlarged view of the gantry and drill feed assembly shown at region A of FIG. 20A.
Figure 21A:
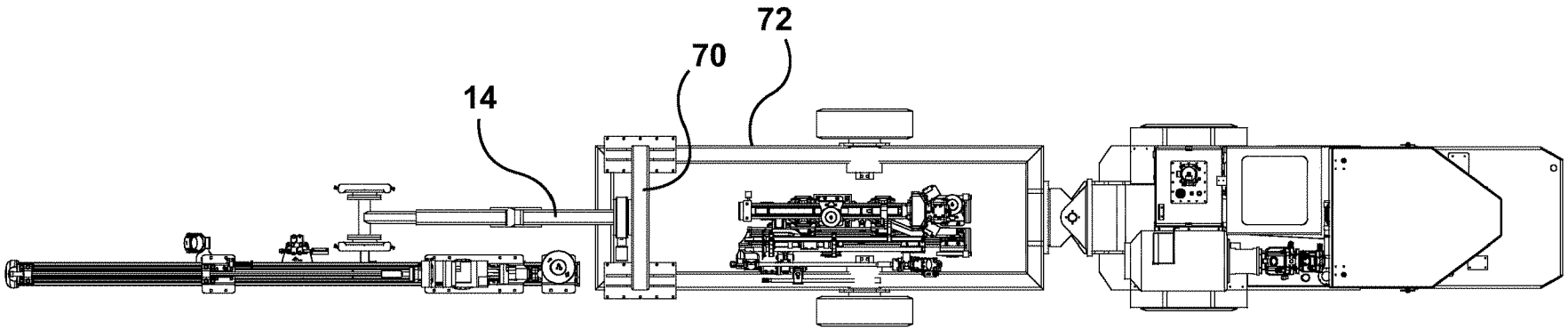
FIG. 21A is a top view of the system of FIG. 20A.
Figure 21B:
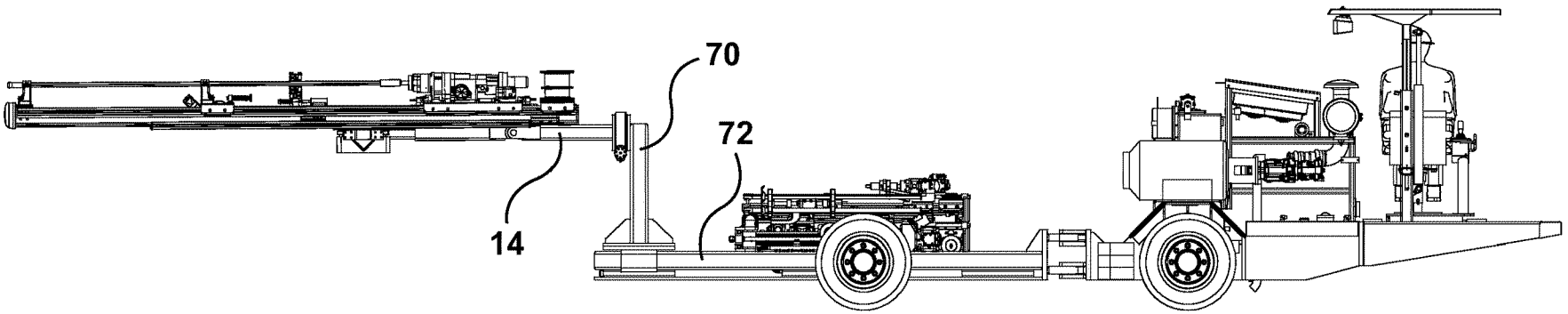
FIG. 21B is a side view of the system of FIG. 20A.
Figure 22A:
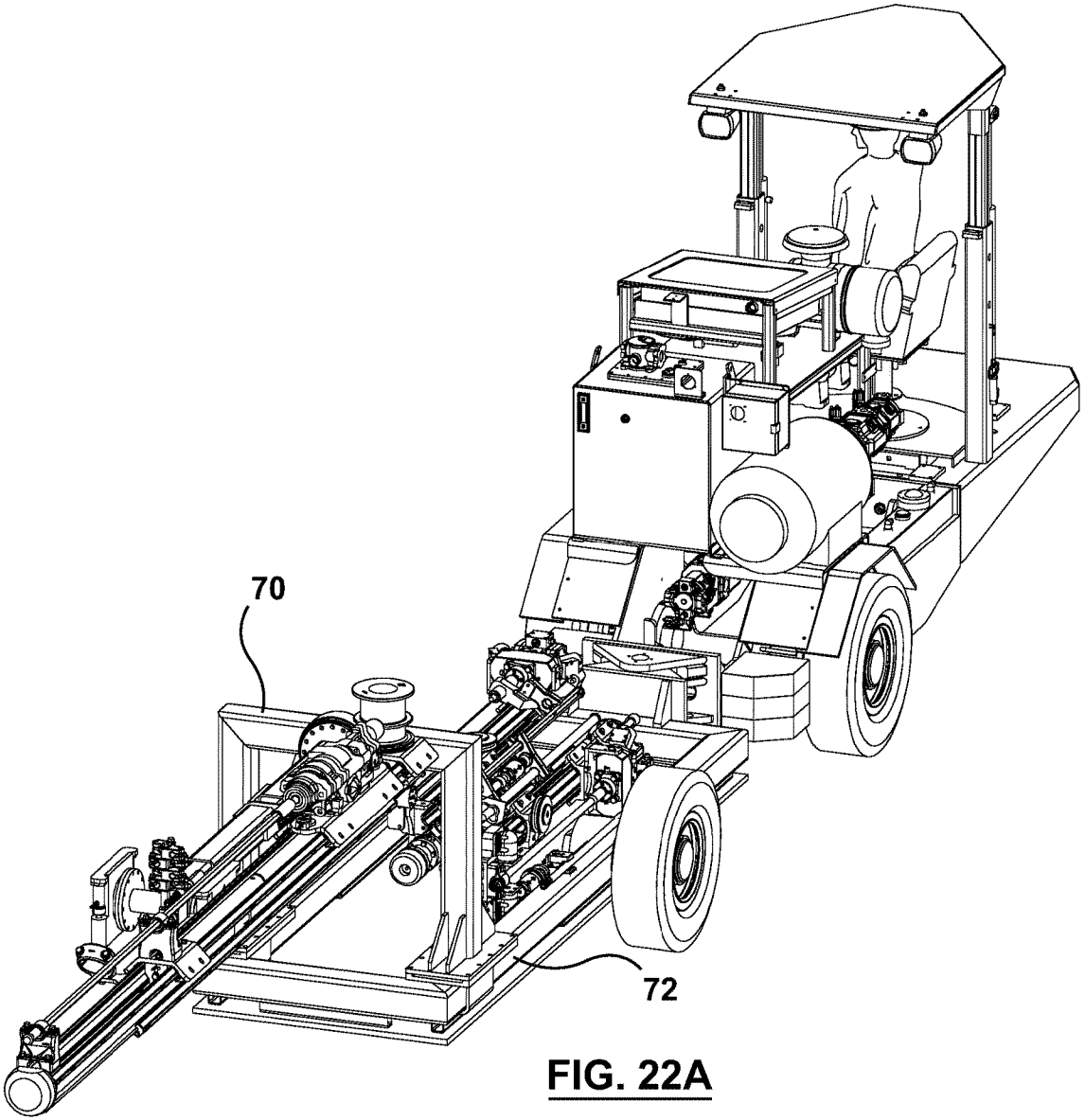
FIG. 22A is a dimetric view of the system of FIG. 20A.
Figure 22B:
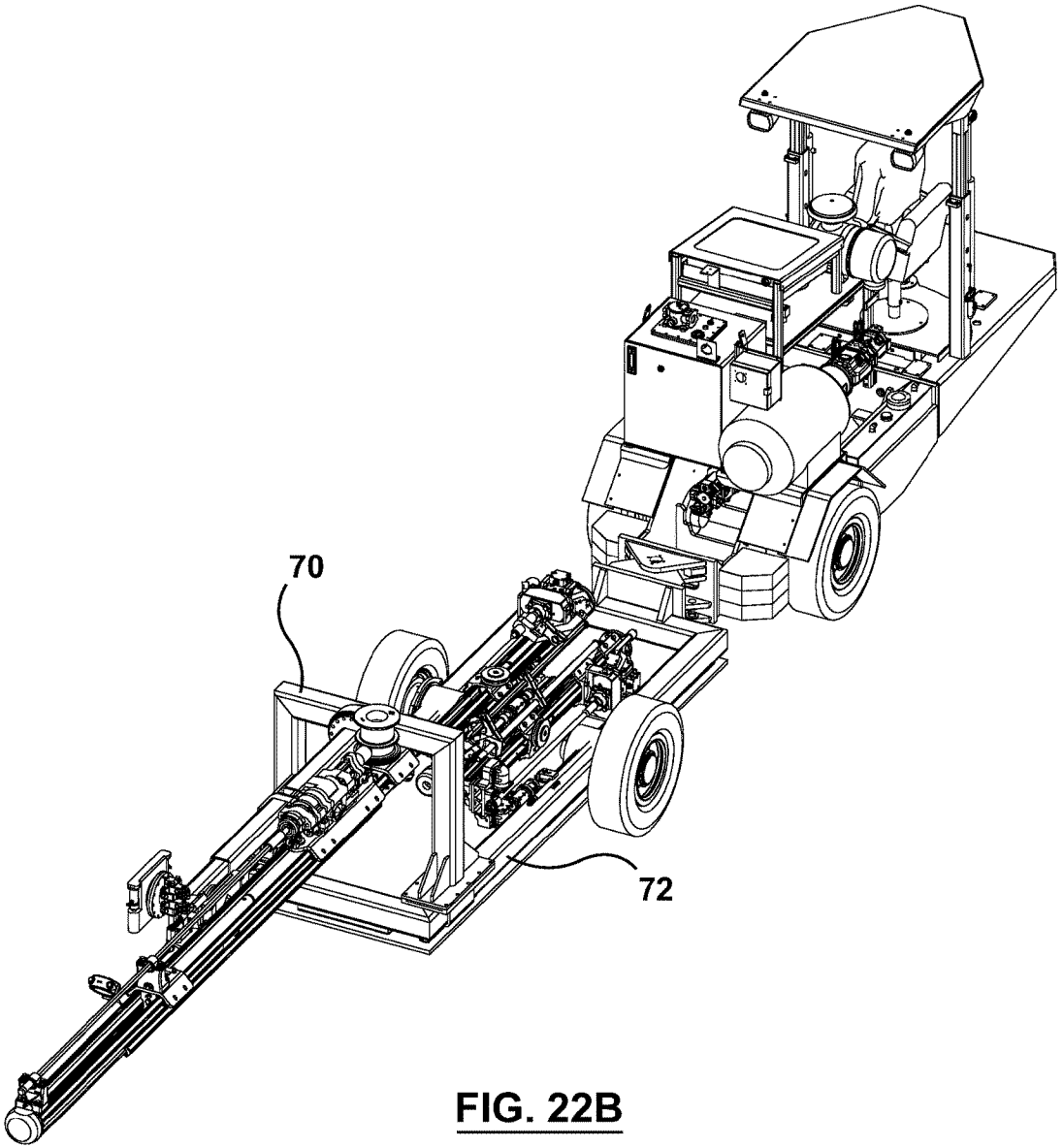
FIG. 22B is a trimetric view of the system of FIG. 20A.

In a second embodiment of the invention, the system 10 has first and second boom assemblies 14*a*, 14*b* for independently supporting the bolter assembly and the drill feed assembly. The second embodiment is illustrated by way of example in FIGS. 9-13. The first and second boom assemblies are generally parallel to each other as shown in FIGS. 10-11. Each of the first and second boom assemblies 14*a*, 14*b* has a first boom member 40*a*, 40*b* and a first actuator 42*a*, 42*b* as well as a second boom member 44*a*, 44*b* and a second actuator 46*a*, 46*b*. In the dual-boom embodiment, there is no need for a T-shaped member since each boom assembly supports only a single unit (i.e. either the bolter assembly or the drill feed assembly). In a third embodiment of the invention, which is depicted in FIGS. 14A-22B, the system 10 includes a gantry (or gantry assembly) 70 disposed at a front of the vehicle 12 or carrier unit. The gantry 70 may be a square or rectangular frame as shown in the figures defining an open space inside the frame so that the gantry may be translated without interfering or colliding with the drill feed assembly or bolter assembly that is stored on the platform. As illustrated in the embodiment depicted in FIGS. 14A-22B, the boom assembly 14 is mounted to the gantry 70 at the front of the vehicle 12 (or carrier unit). The gantry 70 includes a platform (or deck) 72 that serves as a storage area to house or support the drill feed assembly or bolter assembly that is not currently in use.

The gantry 70 extends forward toward the working face of the drift for bolting operations. Once bolting operations are complete, the gantry 70 retracts backwards toward the carrier unit. After the bolter assembly 24 is removed and the drill feed assembly 32 is reattached, the gantry 70 extends forward once again toward the working face of the drift for face drilling operations. Once face drilling is complete, the gantry 70 again retracts backwards towards the carrier unit. The bolter assembly 24 is then reconnected to the boom assembly 14 for transport out of the heading.

FIGS. 14A-16B show the gantry 70 in a retracted position with the drill feed assembly 32 loaded (i.e. ready) for face drilling operations. In this configuration, the bolter assembly 24 is stored on the platform 72.

FIGS. 17A-19B show the gantry 70 in an extended position with the bolter assembly 24 loaded for bolting operations, i.e. installation of rock bolts in the roof. In this configuration, the drill feed assembly is stored on the platform 72.

FIGS. 20A-22B show the gantry 70 in the extended position with the drill feed assembly 32 loaded for drilling operations. In this configuration, the bolter assembly 24 is again stored on the platform 72.

In the third embodiment, the gantry 70 may include feet or supports 74 adapted to slide over the platform 72 to extend or retract relative to the carrier unit. The platform 72, in the illustrated embodiment, may include rail-like frame members 76 defining a rectangular frame around the periphery of the platform. The supports 74 of the gantry may each have a sleeve 78 adapted to slide over the rail-like frame members 76 to advance or retreat. The gantry 70 may be displaced using any suitable hydraulic, pneumatic or electric motor or actuator. In other variants, the gantry may include wheels or rollers to roll, instead of slide, over the rail-like frame members.

As illustrated in FIGS. 14A-22B, the boom assembly 14 is rotatable by a rotary motor 80 that is connected between the boom assembly 14 and the gantry 70. In the specific embodiment shown in these figures, the rotary motor 80 is positioned on an upper horizontal member 82 of the gantry 70. In the third embodiment, the boom assembly may include actuators or motors to enable the user to position and orient the drill feed assembly and the bolter assembly.

In the third embodiment, the vehicle or carrier unit 12 is an articulated four-wheel vehicle (although another type of vehicle or carrier unit may be used) having a forward part and a rearward part which are articulated or hitched together. The rearward part has two wheels supporting the cabin/cockpit and the power plant. The forward part includes the platform on which two wheels are mounted. The gantry and boom assembly are supported by the platform as shown by way of example. This example carrier unit is only way of embodying this aspect of the invention. It will be appreciated that other vehicles or carrier units may incorporate a gantry using different layouts, configurations or mechanisms.

Another inventive aspect of this disclosure is a method of bolting and drilling using a single bolting and drilling system in a drift or narrow vein of an underground mine. The method entails driving a vehicle inside the drift or narrow vein to a heading of the drift or narrow vein having a roof to be drilled and bolted and a face to be drilled. The vehicle includes a boom assembly having a first end mounted to the vehicle and a second end having a first quick connector and a second quick connector. A bolter assembly is connectable to the first quick connector. The bolter assembly comprises a stinger, a drill and a bolter for stinging, drilling and bolting a roof of a drift or narrow vein of an underground mine. A drill feed assembly is connectable to the second quick connector. The drill feed assembly comprises a drill for drilling a rock face of a heading of the drift or narrow vein, wherein the drilling assembly or drill feed assembly is longer than the bolter assembly. The method further entails disconnecting the drill feed assembly, drilling and bolting the roof using the bolter assembly, and disconnecting the bolter assembly. The method continues by connecting the drill feed assembly and drilling the face using the drill feed assembly.

The method may further continue by connecting the bolter assembly for transport and driving the vehicle away from the heading before blasting the heading. The method may be continued by repeating the bolting, drilling and blasting steps to thereby advance the heading of the drift or narrow vein.

The method may optionally involve displacing the drill feed assembly and the bolter assembly using a gantry that translates relative to the vehicle to thereby extend or retract the drill feed assembly and the bolter assembly.

Although the embodiments of this invention are particularly useful for narrow vein mining, the embodiments of this invention may also be used on larger equipment in larger drifts. In other words, the embodiments of the invention are not limited to narrow vein mining.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including", "entailing" and "containing", or verb tense variants thereof, are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g., "such as") is intended merely to better illustrate or describe embodiments of the invention and is not intended to limit the scope of the invention unless otherwise claimed.

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A bolting and drilling system comprising:

a vehicle;

a boom assembly having a first end mounted to the vehicle and a second end having a first quick connector and a second quick connector;

a bolter assembly connectable to the first quick connector, wherein the bolter assembly comprises a stinger, a drill and a bolter for stinging, drilling and bolting a roof of an underground mine; and a drill feed assembly connectable to the second quick connector, wherein the drill feed assembly comprises a drill for drilling a rock face of a heading;

wherein the drill feed assembly is longer than the bolter assembly;

wherein the first quick connector comprises a first plate holder for receiving a first plate attached to the bolter assembly to enable quick connection of the bolter assembly to the boom assembly and wherein the second quick connector comprises a second plate holder for receiving a second plate attached to the drill feed assembly to enable quick connection of the drill feed assembly to the boom assembly; and wherein the first and second plate holders each comprises an upper holder component and a lower holder component and wherein each of the first and second plate holders further comprises a pair of parallel linear actuators interconnecting the upper and lower holder components for opening and closing the plate holder to quickly connect or disconnect the first plate holder to the first plate and to quickly connect or disconnect the second plate holder to the second plate.

2. The system of claim 1 wherein the drill feed assembly comprises only the drill such that the drill feed assembly has no bolter.

3. The system of claim 1 wherein the boom assembly comprises:

a first boom member connected at a proximal end to the vehicle and adjustable in pitch by a first boom actuator connected between the vehicle and the first boom member;

a second boom member connected at a proximal end to a distal end of the first boom member and adjustable in pitch relative to the first boom member by a second boom actuator connected between the first boom member and the second boom member;

a rotary motor connected at a proximal end to a distal end of the second boom member and rotatable about an axis aligned with the second boom member; and a T-shaped support member connected at a proximal end to a distal end of the rotary motor, wherein the T-shaped support member includes a first flange for connecting to the first plate and includes a second flange for connecting to the second plate.

4. The system of claim 3 wherein the plates are square and wherein the plate holders define a square-shaped holding space when closed.

5. The system of claim 1 wherein the vehicle comprises four wheels, an open cockpit, a single seat and a plurality of manual controls for manipulating the boom assembly, bolter assembly and drill feed assembly.

6. The system of claim 1 wherein the parallel linear actuators are hydraulic.

7. The system of claim 1 wherein the parallel linear actuators are pneumatic.

8. The system of claim 1 further comprising a gantry disposed at a front of the vehicle to which the boom is mounted, the gantry being movable relative to the vehicle to extend or retract the drill feed assembly or the bolter assembly.

* * * * *